US010876689B1

(12) United States Patent
Bowser

(10) Patent No.: US 10,876,689 B1
(45) Date of Patent: Dec. 29, 2020

(54) LIGHTING TUBE SYSTEM FOR UNIFORM SIGNAGE ILLUMINATION

(71) Applicant: Retinal 3-D, L.L.C., Mesa, AZ (US)

(72) Inventor: Roger C. Bowser, Mesa, AZ (US)

(73) Assignee: Retinal 3-D, L.L.C., Mesa, AZ (US)

( * ) Notice: Subject to any disclaimer, the term of this patent is extended or adjusted under 35 U.S.C. 154(b) by 0 days.

(21) Appl. No.: 16/712,132

(22) Filed: Dec. 12, 2019

Related U.S. Application Data

(60) Provisional application No. 62/779,382, filed on Dec. 13, 2018.

(51) Int. Cl.

| | |
|---|---|
| ***F21K 9/27*** | (2016.01) |
| ***F21S 4/26*** | (2016.01) |
| ***F21Y 115/10*** | (2016.01) |
| ***F21Y 103/10*** | (2016.01) |
| ***F21V 19/00*** | (2006.01) |
| ***F21Y 107/40*** | (2016.01) |
| ***F21S 4/28*** | (2016.01) |

(52) U.S. Cl.
CPC ..... *F21K 9/27* (2016.08); *F21S 4/26* (2016.01); *F21S 4/28* (2016.01); *F21V 19/008* (2013.01); *F21V 19/0075* (2013.01); *F21Y 2103/10* (2016.08); *F21Y 2107/40* (2016.08); *F21Y 2115/10* (2016.08)

(58) Field of Classification Search
CPC ..... F21S 4/00; F21S 4/10; F21S 4/20; F21S 4/22; F21S 4/24; F21S 4/26; F21S 4/28; F21V 19/0075; F21V 19/008; F21V 21/12; F21V 21/32; F21V 21/34; F21V 21/005; F21V 23/001; F21V 23/002; F21Y 2103/10; F21Y 2103/20; F21Y 2111/00; F21Y 2107/30; F21Y 2107/40; F21Y 2107/50; F21Y 2107/80; F21Y 2107/90; F21K 9/27
See application file for complete search history.

(56) References Cited

U.S. PATENT DOCUMENTS

| | | | | |
|---|---|---|---|---|
| 6,641,285 | B2 * | 11/2003 | Liu | H01J 61/30 362/223 |
| 8,944,669 | B2 * | 2/2015 | Chien | G03B 15/03 362/642 |
| 2003/0012019 | A1 * | 1/2003 | Pan | F21V 9/08 362/231 |
| 2009/0213584 | A1 * | 8/2009 | Jansma | H01J 61/72 362/225 |

(Continued)

*Primary Examiner* — Bryon T Gyllstrom
*Assistant Examiner* — James M Endo
(74) *Attorney, Agent, or Firm* — Booth Udall Fuller, PLC

(57) ABSTRACT

A lighting tube for uniform illumination is disclosed. The lighting tube includes a conduit having an inner layer, outer layer, and a middle layer between the inner and outer layers. The middle layer has at least two of a phosphor film, a diffusion film, and a UV-blocking film. The lighting tube also includes a light emitting chain located inside of the conduit. The light emitting chain includes control wires and a plurality of light emitting units spaced along the control wires. Each unit has a plurality of faces interconnected to form a polygon when viewed along a central axis, with each face being on a different side of the polygon. Each face has an LED coupled to the control wires. The LED emits light with a wavelength that causes the phosphor film to luminesce. The illumination of the middle layer by the chain is substantially uniform in all radial directions.

20 Claims, 20 Drawing Sheets

(56) References Cited

U.S. PATENT DOCUMENTS

| | | | | |
|---|---|---|---|---|
| 2012/0008314 | A1* | 1/2012 | Simon | F21K 9/27 362/217.1 |
| 2014/0153230 | A1* | 6/2014 | Mii | F21V 9/30 362/217.08 |
| 2014/0321126 | A1* | 10/2014 | Narag | F21K 9/00 362/306 |
| 2014/0369038 | A1* | 12/2014 | Tischler | G09F 13/00 362/235 |
| 2015/0345755 | A1* | 12/2015 | Purdy | F21V 17/16 362/219 |
| 2015/0377428 | A1* | 12/2015 | Chen | F21V 9/38 362/84 |
| 2016/0146445 | A1* | 5/2016 | Shine | F21V 21/096 362/234 |
| 2016/0348859 | A1* | 12/2016 | Wang | F21K 9/64 |
| 2016/0377277 | A1* | 12/2016 | Wei | F21V 29/51 362/249.02 |

* cited by examiner

LIGHTING TUBE SYSTEM FOR UNIFORM SIGNAGE ILLUMINATION

RELATED APPLICATIONS

This application claims the benefit of U.S. provisional patent application 62/779,382, filed Dec. 13, 2018 titled "Flexible LED Lighting Tube Insert and Intermediate Layer" the entirety of the disclosure of which is hereby incorporated by this reference.

TECHNICAL FIELD

Aspects of this document relate generally to lighting tubes.

BACKGROUND

Neon and fluorescent lighting tubes have been in use for over a century, and are often seen in general lighting, advertising, and entertainment signs. They are made of long, narrow glass tubes that are often bent through delicate heating to form all sorts of shapes, logos, and words. The neon and fluorescent lighting tubes are each designed to emit a light. Neon lights are generally formed by filling a tube with a low-pressure gas or vapor and then applying a high electrical potential between two electrodes at either end of the tube. The potential between the electrodes ionizes the gas, causing it to emit light. The wavelength of light given off by the neon or fluorescent lighting is particular to the type of gas in the glass tube (for example, hydrogen neon-red, helium-yellow, carbon dioxide-white, and mercury-blue) or particular to a phosphor coating of the tube that luminesces when exposed to the light emitted by the ionization. Both neon lights and fluorescent lights, however, require low-pressure vapor or gas to operate.

Neon and fluorescent lights are often costly and difficult to repair. The glass tubes of neon lights can be bent and shaped, allowing sign makers to create signs that appear to be drawn in light itself. However, those glass tubes are also fragile. A single crack or breach in a tube corrupts the low-pressure gas within, making repair costly, if not impossible. Fluorescent tubes often explode when broken and can be very hazardous to handle. The visually appealing designs that make use of long, unbroken lines can be ruined with a single crack. Additionally, the fragility of neon and fluorescent lights further complicates transport and installation.

Modern, conventional forms of tube or shapeable lighting often employ LEDs, arranged in strands or strips. LEDs are power efficient and tend to be less fragile than neon or fluorescent lights. However, these modern solutions fail to recreate the even glow of a neon or fluorescent tube that provides uniform illumination in all directions. The discrete LEDs used in conventional solutions often result in illumination that is stronger in one direction than another, creating bright spots, and dark or dim spots.

SUMMARY

According to an aspect of the disclosure, a lighting tube for uniform illumination may comprise a conduit comprising a plurality of conduit segments that are hollow, each conduit segment comprising an inner layer, outer layer, and a middle layer between the inner layer and outer layer, the middle layer comprising at least two of a phosphor film comprising a first phosphor, a diffusion film that is translucent, and a UV-blocking film, and a light emitting chain located inside of and extending along a length of the conduit, the light emitting chain comprising a plurality of control wires, and a plurality of light emitting units spaced along and communicatively coupled in series through the plurality of control wires, each light emitting unit comprising a plurality of faces interconnected to form a polygon when viewed along a central axis of the light emitting unit, with each face of the plurality of faces being on a different side of the polygon, each face being a substrate having an LED communicatively coupled to the plurality of control wires, the LED capable of emitting light with a first wavelength that causes the first phosphor of the phosphor film to luminesce along the length of the light tube, wherein the illumination of the middle layer by the light emitting chain is substantially uniform in all radial directions, and wherein each conduit segment is coupled to a neighboring conduit segment such that the middle layer of the conduit segment meets the middle layer of the neighboring segment across an interface surface having a surface area greater than the radial cross-sectional area of the middle layer of the conduit segment.

Particular embodiments may comprise one or more of the following features. The phosphor layer may further comprise a second phosphor different from the first phosphor, and wherein each face of each light emitting unit comprises an LED capable of emitting light with a second wavelength that causes the second phosphor of the phosphor film to luminesce. The first phosphor may be distributed in the phosphor film to form a pattern. Each face may comprise at least two of an ultraviolet LED, a RGB LED, a RGBW LED, a white LED, and a single wavelength LED.

According to an aspect of the disclosure a lighting tube may comprise a conduit comprising at least one conduit segment that is hollow, each of the at least one conduit segment comprising an inner layer, outer layer, and a middle layer between the inner layer and outer layer, and a light emitting chain located inside of and running along a length of the conduit, the light emitting chain comprising a plurality of control wires, and a plurality of light emitting units spaced along and communicatively coupled in series through the plurality of control wires, each light emitting unit comprising a plurality of faces interconnected to form a polygon when viewed along a central axis of the light emitting unit, with each face of the plurality of faces on a different side of the polygon, each face being a substrate having an LED communicatively coupled to the plurality of control wires, wherein the middle layer allows, at most, a portion of the light emitted by the light emitting chain to pass through the outer layer, wherein the illumination of the middle layer by the light emitting chain is substantially uniform in all radial directions, and wherein each of the at least one conduit segment is coupled to a neighboring conduit segment such that the middle layer of the at least one conduit segment meets the middle layer of the neighboring segment across an interface surface having a surface area greater than the radial cross-sectional area of the middle layer of the at least one conduit segment.

Particular embodiments may comprise one or more of the following features. The middle layer may comprise a phosphor film comprising a first phosphor, and wherein the LED of each face is capable of emitting light with a first wavelength that causes the first phosphor to luminesce along the length of the light tube. The phosphor layer may further comprise a second phosphor different from the first phosphor, and wherein each face of each light emitting unit comprises an LED capable of emitting light with a second wavelength that causes the second phosphor of the phosphor film to luminesce. The first phosphor may be distributed in the phosphor film to form a pattern. The middle layer may comprise a diffusion film that is translucent. Each face may comprise at least two of an ultraviolet LED, a RGB LED, a RGBW LED, a white LED, and a single wavelength LED.

According to an aspect of the disclosure, a lighting tube may comprise a conduit, and a light emitting chain surrounded by and running along a length of the conduit, the light emitting chain comprising a plurality of control wires, and a plurality of light emitting units spaced along and communicatively coupled in series through the plurality of control wires, each light emitting unit comprising a plurality of faces interconnected to form a polygon when viewed along a central axis of the light emitting unit, with each face of the plurality of faces being on a different side of the polygon, each face being a substrate having an LED communicatively coupled to the plurality of control wires, and wherein the illumination of the plurality of layers by the light emitting chain is substantially uniform in all radial directions.

Particular embodiments may comprise one or more of the following features. The plurality of layers may comprise an inner layer, outer layer, and a middle layer between the inner layer and outer layer. The middle layer may allow, at most, a portion of the light emitted by the light emitting chain to pass through the outer layer. The middle layer may comprise a phosphor film comprising a first phosphor. The middle layer may further comprise a UV blocking film between the phosphor film and the outer layer. The phosphor layer may further comprise at least a second phosphor different from the first phosphor, and wherein each face of each light emitting unit comprises an LED capable of emitting light with a second wavelength that causes the at least a second phosphor of the phosphor film to luminesce. The first phosphor may be distributed in the phosphor film to form a pattern. The middle layer may comprise a diffusion film that is translucent. At least one of the plurality of layers is clear. The conduit may comprise a plurality of conduit segments, and wherein each conduit segment is coupled to a neighboring conduit segment such that an active layer of the conduit segment meets the active layer of the neighboring segment across an interface surface having a surface area greater than the radial cross-sectional area of the active layer of the conduit segment. Each face may comprise at least two of an ultraviolet LED, a RGB LED, a RGBW LED, a white LED, and a single wavelength LED.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The disclosure will hereinafter be described in conjunction with the appended drawings, where like designations denote like elements, and.

DETAILED DESCRIPTION

Figure 1:
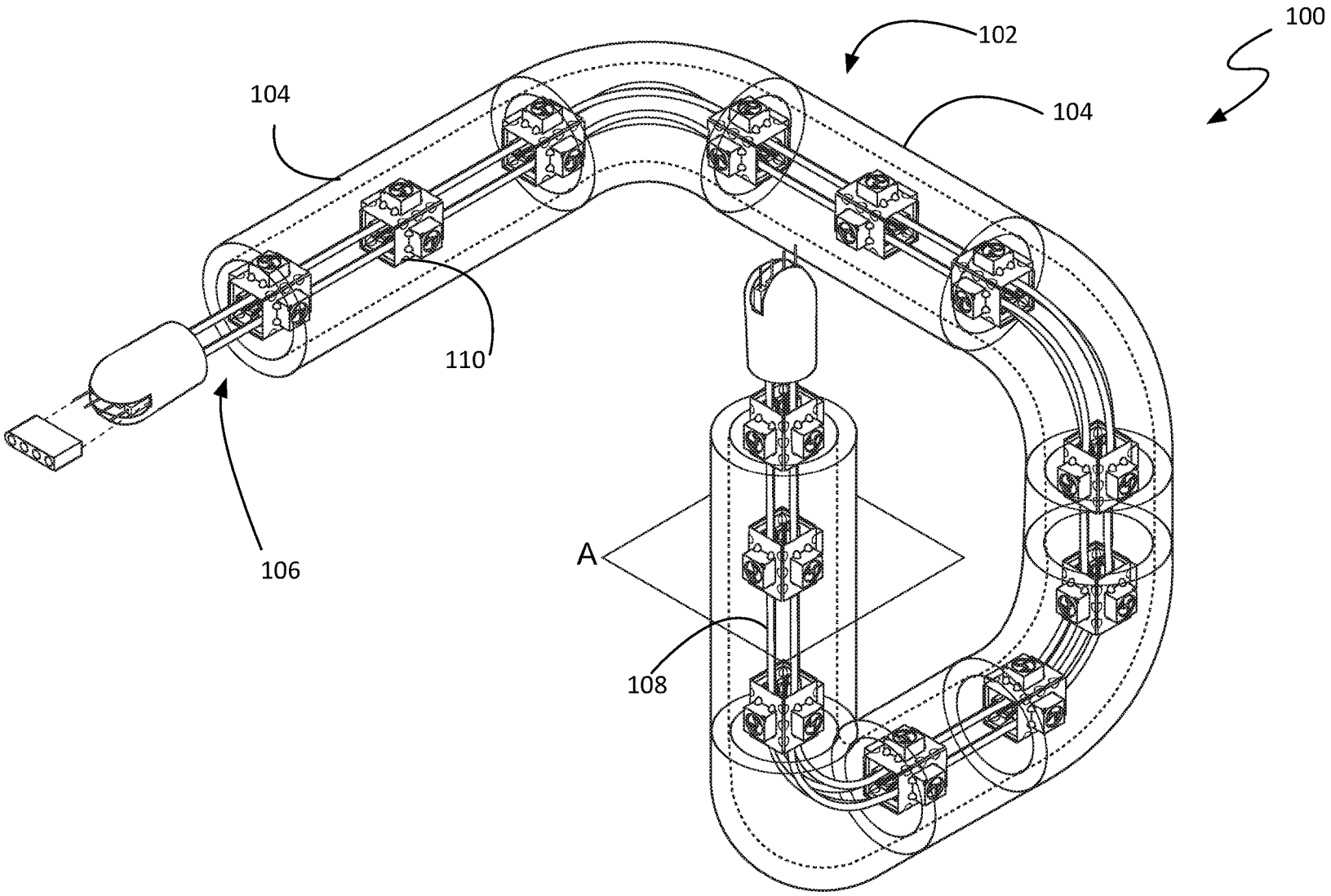
FIG. 1 is a perspective view of a lighting tube.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

As explained earlier, neon lighting tubes are made of long, narrow glass tubes that are often bent into all sorts of shapes, logos, and words. Neon lights are generally formed by filling a glass tube with a low-pressure gas or vapor and then applying a high electrical potential between two electrodes at either end of the tube. The potential between the electrodes ionizes the gas, causing it to emit light. The wavelength of light given off by the neon lighting is particular to the type of gas in the tube or particular to a phosphor coating of the tube that luminesces when exposed to the light emitted by the ionization.

Fluorescent lights operate under a similar principal. The are typically long and straight, and produce a white light for use in offices, stores and homes. For a conventional fluorescent light, the tube is filled with a rarified mercury vapor that, when ionized, emits ultraviolet light. The inside of the fluorescent light is coated with a phosphor that can accept energy in one form (e.g. UV light produced by ionizing the mercury vapor) and emit the energy in another form (e.g. light in the visible spectrum). Thus, the light seen from a fluorescent tube is the light given off by the phosphor that coats the inside of the tube and fluoresces. The light seen from a neon tube is generated from the type of gas used and/or in conjunction with a specific type of phosphor coating lining the inside of the tube. Both neon lights and fluorescent lights, however, require low-pressure vapor or gas to operate.

Contemplated herein are lighting tubes for uniform illumination that provide a "glow" look similar to neon or fluorescent lighting tubes, but using a different construction that is robust and illuminates evenly in all directions. The embodiments provided herein do not require a pressurized vapor or gas within the lighting tube to generate light in the way conventional pressurized lighting tubes do. Instead, the lighting tubes disclosed herein employ solid state light sources such as LEDs that are much more durable.

Additionally, the lighting tube system contemplated herein makes use of a layered conduit that, combined with a unique internal LED light source, provides substantially uniform illumination in all directions. This is advantageous over conventional LED based tube or formable lighting, which tend to provide illumination directly from discrete points facing in one to three directions, failing to recreate the uniform glow of neon or fluorescent lighting. The lighting tubes disclosed herein provide the design versatility and uniform glow of neon and fluorescent tubes with the durability and affordability of LEDs.

FIG. 1 is a perspective view of a non-limiting example of a lighting tube for uniform illumination. As shown, the lighting tube 100 comprises a conduit 102 that contains a light emitting chain 106. The conduit 102 shown in FIG. 1 is depicted as essentially transparent. In some embodiments the conduit 102 may be transparent or translucent, while in other embodiments the conduit 106 may be opaque, at least to light in the visible range.

As shown, the light emitting chain 106 (hereinafter "chain 106") comprises a plurality of discrete light emitting units 110 (hereinafter "units 110") that are spaced along and communicatively coupled in series through a plurality of control wires 108. Each unit 110 in the chain 106 is able to emit light in a plurality of directions. The light emitting units 110 will be discussed in greater detail with respect to FIGS. 6A-6C, below. The wiring of the units 110 within the chain 106 will be discussed with respect to FIGS. 7A and 7B, below.

In some embodiments, the conduit 102 may be hollow, while in other embodiments the conduit 102 may be solid, or enclose a material, structure, or framework to keep the chain 106 close to the center of the conduit 102 (e.g. when the conduit 102 is much wider than the units 110, etc.). In some embodiments the conduit 102 is a single piece, though it may comprise a plurality of layers. In other embodiments, including the non-limiting example shown in FIG. 1, the conduit 102 may be made up of a plurality of conduit segments 104 connected to each other. It should be noted that while the subsequent discussion will be done in the context of a conduit 102 made up of segments 104, what is said regarding the manufacture, structure, and function of the conduit segments 104 is applicable to various embodiments where the conduit 102 is a single, unitary layered tube.

The lighting tubes 100 contemplated herein may be shaped into various three-dimensional shapes similar to neon lighting tubes, according to various embodiments. In some embodiments, conduit segments 104 may be manufactured having a variety of shapes and/or lengths which may subsequently be used to form a conduit 102 having the desired appearance. In other embodiments, the conduit 102 or conduit segments 104 may be heated and bent to form the desired angles at the desired positions.

The light emitting chain 106 is flexible within the segments of control wires 108 between the units 110. This allows the chain 106 to be pulled through the conduit 102, even around corners or loops. The "agility" and strength of the chain 106 is determined, in large part, by the length, number, flexibility, and strength of the plurality of control wires 108. In some embodiments, the chain 106 is placed in the conduit prior to bending, while in others the chain 106 may be pulled through the conduit 102 after it has been shaped and/or assembled.

The conduit segments 104 shown in FIG. 1 all have a cylindrical shape, or a circular cross section cut by a plane perpendicular to the central axis of path of the segment 104 (e.g. plane A) or, in other words, a radial cross section. In some embodiments, the conduit 102 or conduit segments 104 may be cylindrical or have circular radial cross sections. In other embodiments, the conduit 102 or conduit segments 104 may have any other desired shape or radial cross section that produces a desired appearance or functionality. In some embodiments, the conduit 102 may have a radial cross section that changes shape, size, and or orientation along the path of the conduit 102 (e.g. swelling, twisting, etc.).

Figure 2A:
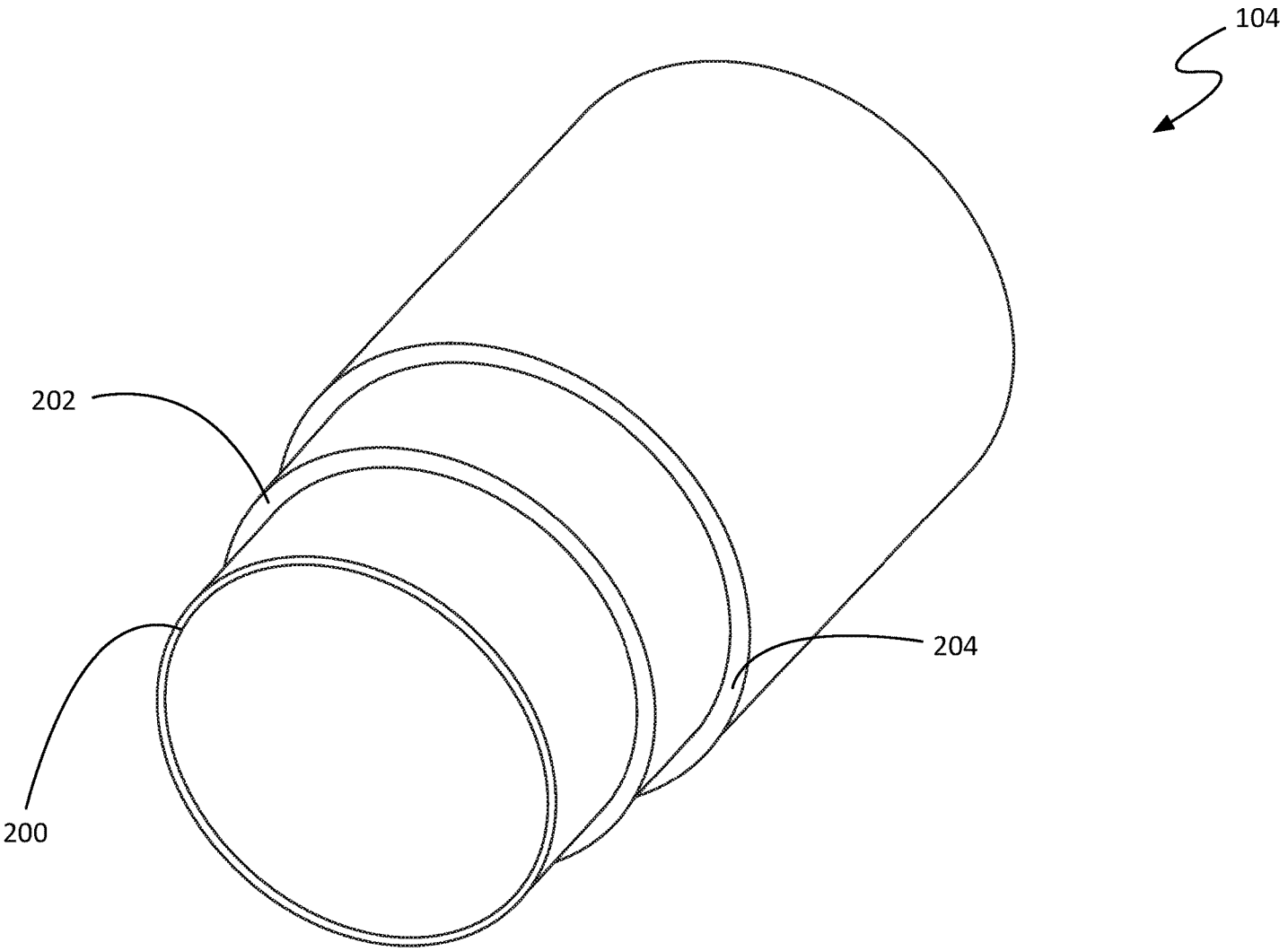
FIG. 2A is a perspective view of a conduit segment.
Figure 2B:
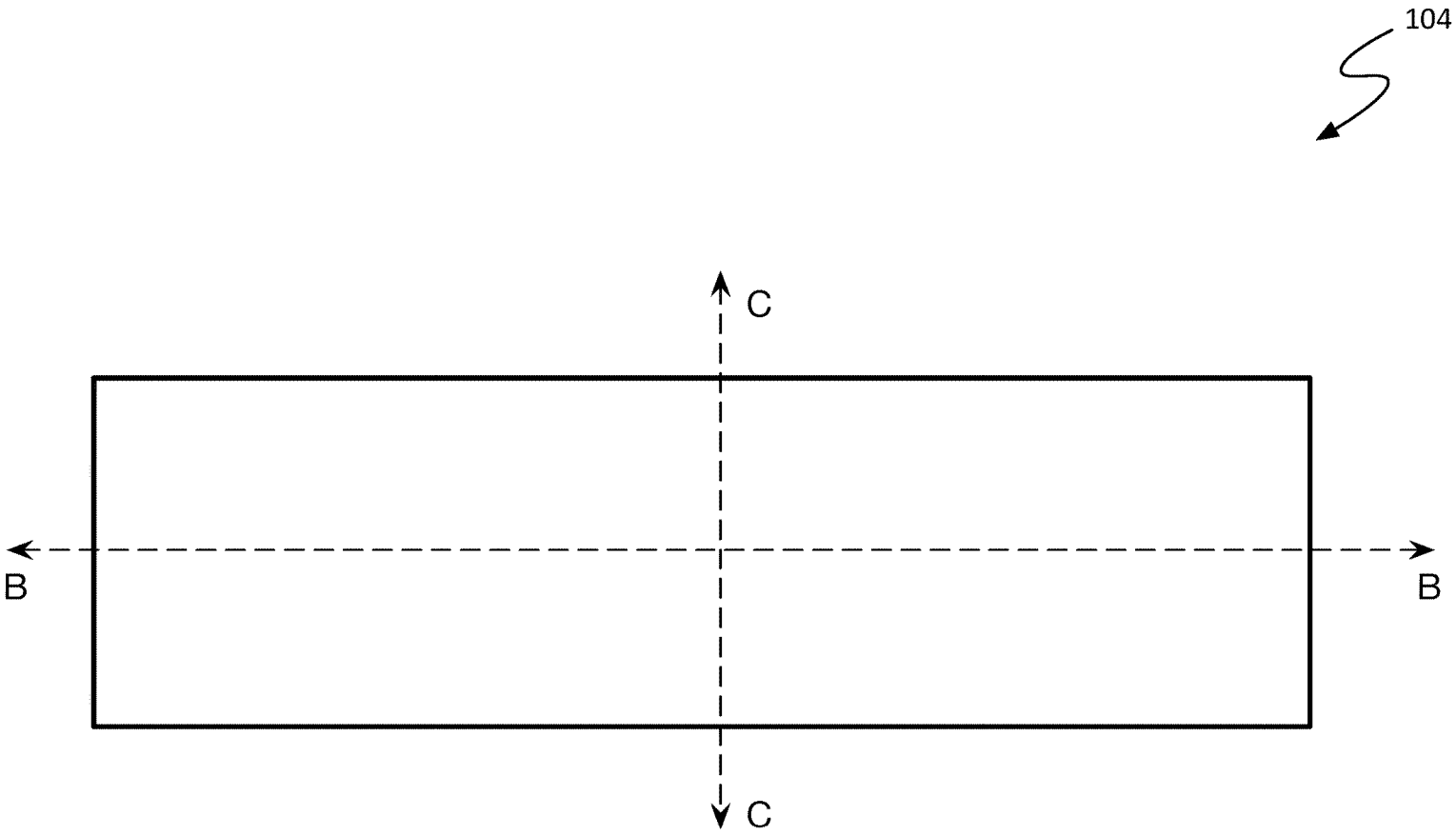
FIG. 2B is a side view of a conduit segment.

FIGS. 2A and 2B are perspective and side views, respectively, of a non-limiting example of a conduit segment 104. According to various embodiments, the conduit segments 104 comprise a plurality of layers, or strata having different composition and/or function. For example, as shown, in some embodiments, the conduit segments 104 may have an inner layer 200, an outer layer 204, and a middle layer 202 between the inner layer 200 and the outer layer 204. In some embodiments, one or more of these layers may itself be made up of layers or films, while in other embodiments, one or more of these layers may be of singular composition.

According to various embodiments, the innermost (e.g. inner layer 200) and outermost (e.g. outer layer 204) layers serve as barriers that protect one or more layers sandwiched in between (e.g. middle layer 202). These protective layers may comprise a clear, transparent or translucent material, such as a thermoplastic or similar synthetic material. Other embodiments may omit one or both of these protective layers, depending on the nature of the other layer or layers of the conduit 102. In still other embodiments, and as still represented by FIGS. 2A and 2B, the protective layers surrounding the middle layer 202 may be only a single layer infused with phosphor, diffusing or other reactive agent rather than being painted or otherwise applied to an outside surface. In such cases, the middle layer 202 alone would be sufficient and because the layer would be an infused layer (similar to the previously described inner layer 200 or outer layer 204, but infused with phosphor), the phosphor would be protected against being scratched away through contact with the light units or some other external part.

The middle layer 202 or layers serve as a functional layer, according to various embodiments. For example, in some embodiments, it may emit, diffuse, and/or block light of one or more wavelengths. The specifics of this middle, functional layer 202 will be discussed in greater detail with respect to FIG. 4, below. According to various embodiments, the inner layer 200 and outer layer 204 protect the middle layer 202, which may be fragile, allowing a light emitting chain 106 to be pulled through the conduit 102 without scraping or otherwise damaging the middle layer 202.

Figure 3A:
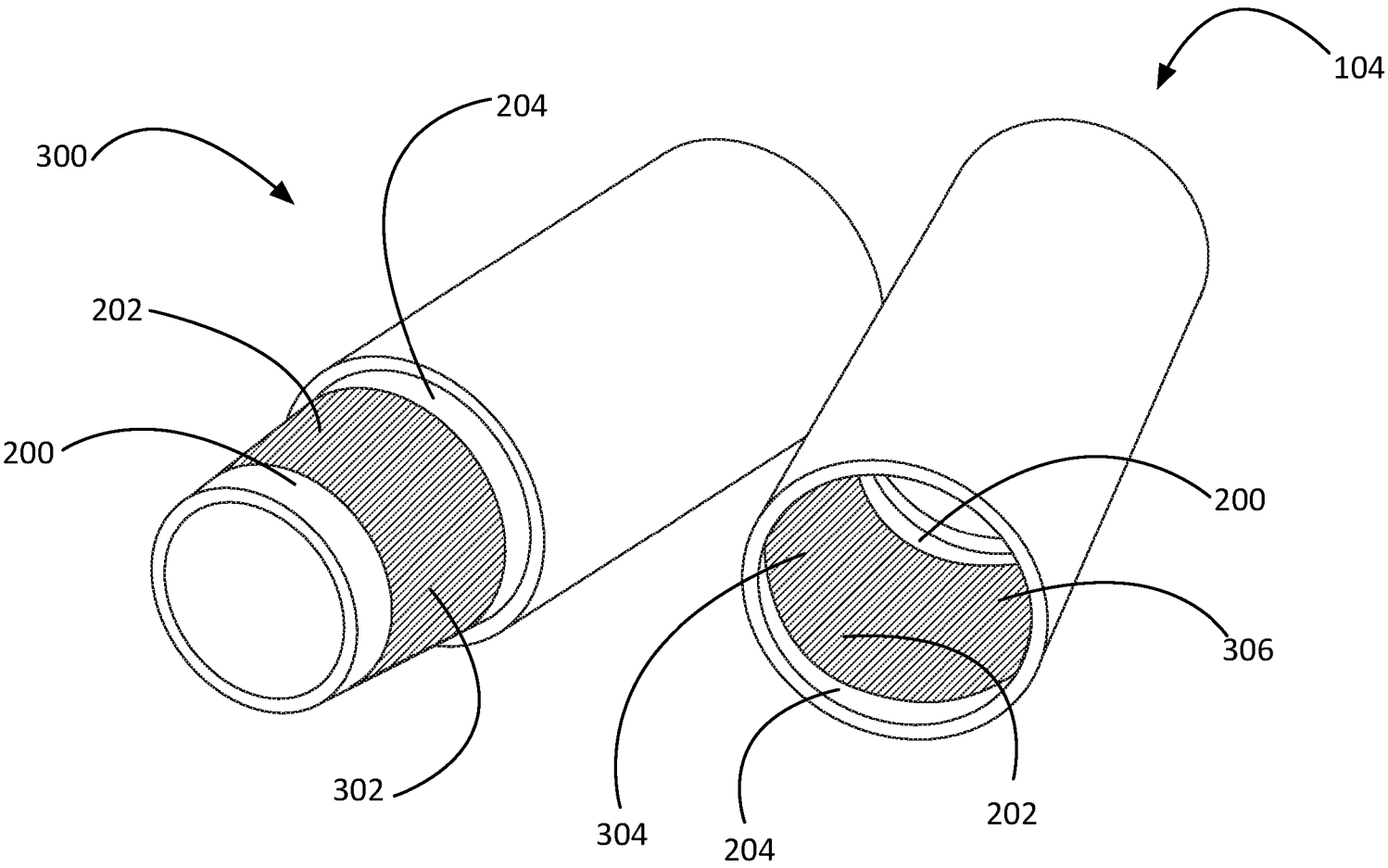
FIG. 3A is a perspective view of two separate conduit segments.
Figure 3B:
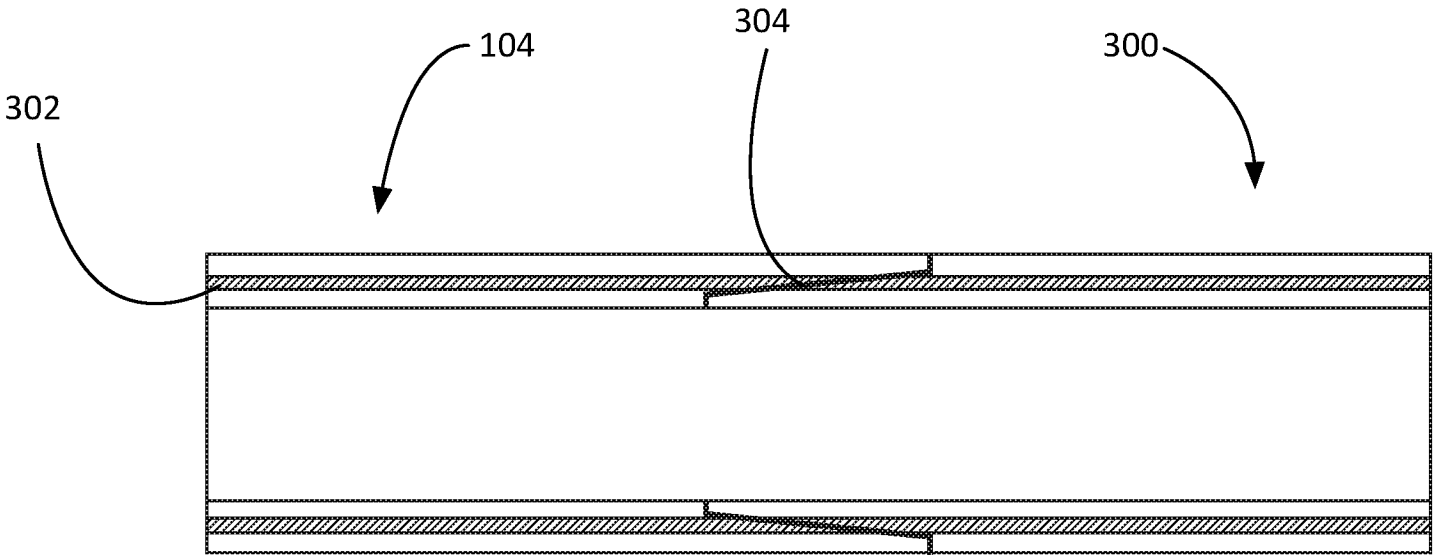
FIG. 3B is a cross-sectional view of two joined conduit segments taken along line B-B of FIG. 2B.
Figure 3C:
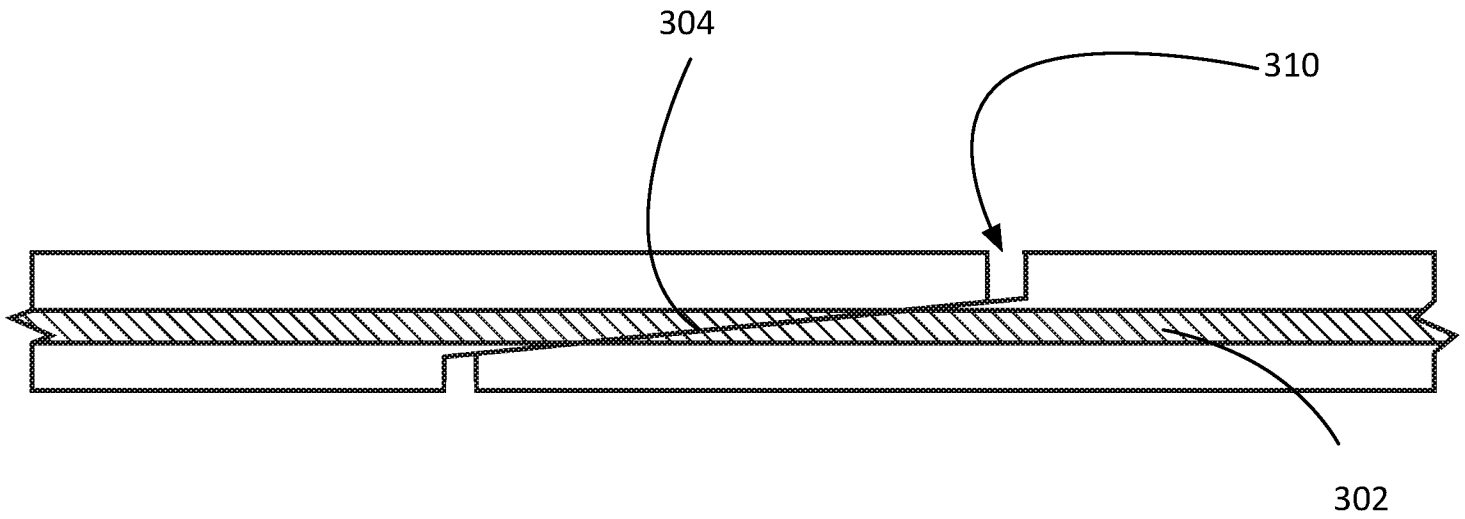
FIGS. 3C and 3D are close-up views of a cross-section of a segment junction along line B-B of FIG. 2B.
Figure 3D:
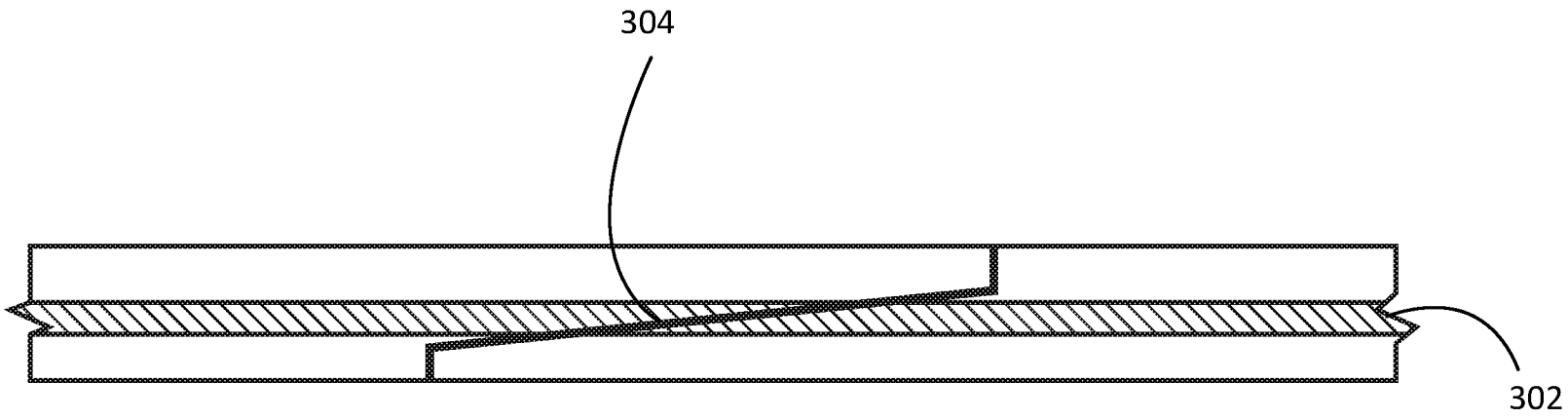

FIGS. 3A-3D show various views of a non-limiting example of a conduit 102 made of two conduit segments 104. Specifically, FIG. 3A is a perspective view of the two conduit segments 104, before assembly. FIG. 3B is a cross-sectional view of the conduit segments 104 along line B-B of FIG. 2B. FIGS. 3C and 3D are close up views of the junction of the two segments 104.

As previously mentioned, in some embodiments multiple conduit segments 104 may be adapted to fit together, creating a larger conduit 102 in the desired shape. A potential problem complicating the use of conduit segments 104 is the middle layer 202, or active layer 302 in some embodiments (e.g. optically functional layer that is not the middle of three layers, etc.). Since the active layer 302 generates or modifies light in some meaningful way (e.g. emission, diffusion, reflection, absorption, etc.), discontinuities in the active layer will be visible, and the lighting tube 100 will no longer resemble the smooth, unbroken line of a neon light tube. It should be noted that a middle layer 202 is always an active layer 302, but an active layer 302 is not necessarily a middle layer 202.

According to various embodiments, the conduit segments 104 may be shaped such that, at their ends, the exposed area of the active layer 302 is increased, reducing the severity of discontinuity in that layer at the junction of two segments 104. As shown in FIGS. 3A-3D, in some embodiments, the segments 104 may be made with a taper at the end over which the active layer 302 may be exposed.

Thus, when two tubes are joined together, the active layer 302 from one conduit segment 104 may be put directly in contact with the active layer 302 from a neighboring conduit segment 300. As shown, the active layers 302 of the two segments meet across an interface surface 304 that, because of the taper or shape of the segment ends, has a surface area 306 that is greater than the radial cross-sectional area 308 of the active layer 302 of a segment 104. Increasing the surface area of the interface surface 304 reduces the severity of any discontinuity of the active layer 302 in the conduit across the junction between the segment 104 and its neighbor 300. In other words, the shape of the ends ensures that, at the junction between segments 104, there is never a break in the active layer 302 that extends from one side of the active layer 302 to the other, in a radial direction of the conduit 102. Put differently, across the junction between two conduit segments 104, the radial cross section of the active layer 302 of the conduit 102 is never completely discontinuous. It should be noted that the shape of the interface surface 304 shown in FIGS. 3B-3D (i.e. the taper) is exemplary and non-limiting; those skilled in the art will recognize that the interface surface 304 may have a variety of shapes resulting in reduced discontinuities in the active layer 302, limiting the visibility of the junction.

The conduit segments 104 may be joined in a variety of ways. For example, the segments may be fully (e.g. FIG. 3D) or partially (e.g. FIG. 3C) seated together and separated by a gap 310, in which case the tightness of the fit would be the only thing holding the two segments 104 together. Alternatively, in either case, a sealer and/or an adhesive may be used.

Figure 4:
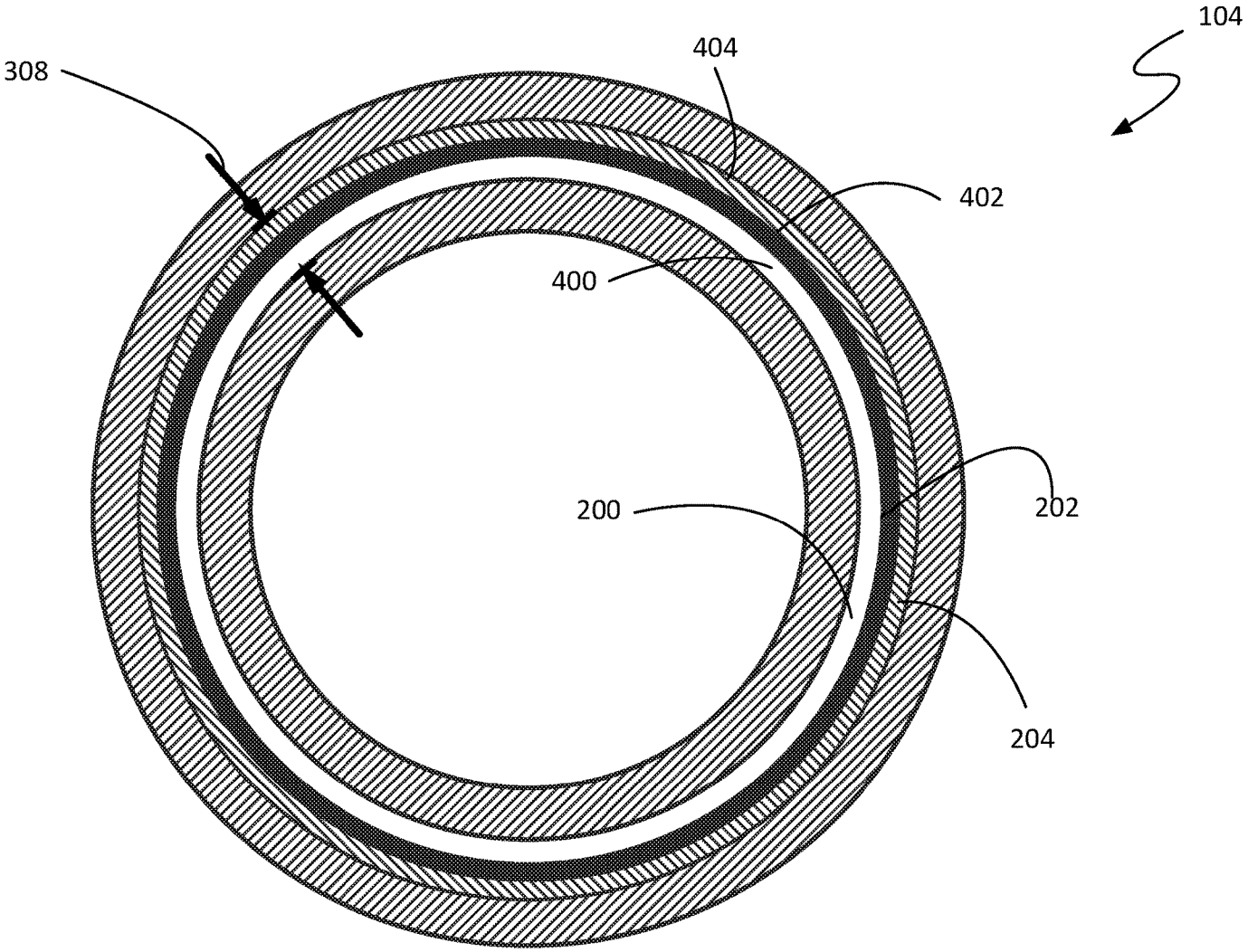
FIG. 4 is a cross-sectional view of a conduit segment taken along line C-C of FIG. 2B.

FIG. 4 is a cross-sectional view of a non-limiting example of a conduit segment 104, taken along line C-C of FIG. 2B. It should be noted that the thickness of the middle layer 202 is exaggerated, for demonstration purposes, and should not be interpreted as limiting. Additionally, while the following discussion will be done in the context of a middle layer 202 in a three layer conduit, those skilled in the art will recognize that these teachings will also be applicable to an active layer 302, which may or may not be a middle layer 202 in a three layer conduit segment 104.

As previously mentioned, according to various embodiments the middle layer 202 (or active layer 302) generates or modifies light in a meaningful way. In the context of the present description and the claims that follow, to modify light in a meaningful way means to modify light more than it is modified by one or more protective layers (e.g. inner layer 200, outer layer 204, etc.), since all layers will interact with photons in one way or another.

In some embodiments, the middle layer 202 may comprise a phosphor film 400. In the context of the present description and the claims that follow, a phosphor film 400 is a layer or a strata within an active layer 302 that comprises a phosphor that luminesces when exposed to light produced by the light emitting units 110.

The type of phosphor(s) used in conjunction with a specific wavelength determines the color(s) that are emitted from the phosphor film 400. In some embodiments, the phosphor layer 400 is excited by UV LEDs. For example, yttrium oxide-sulfide emits red light, zinc cadmium sulfide emits yellow light, copper cadmium sulfide emits green light, and silver zinc sulfide emits blue light. In other embodiments, a pleasing effect can be produced by using a phosphor coating in conjunction with full color range RGB-RGBW LEDs, as most LEDs emit some UV radiation. Furthermore, to produce the effect of a fluorescent tube using the lighting tube 100, a phosphor that glows white or white-white will generally be used, such as a phosphor responding to the wavelengths 405 nm, 436 nm and/or 545 nm, so that whatever UV wavelength is emitted from the units 110 in conjunction with the type of phosphor coating used determines the kelvin temperature of the light produced.

Another method for the manufacture of a conduit 102 incorporating a phosphor is provided in U.S. Pat. No. 2,644,113 to Etzkorn, titled "Luminous Body", the disclosure of which is hereby incorporated herein by reference. Although Etzkorn relates specifically to creating pressurized casings for neon or fluorescent lighting, the methods and structures for the casing of Etzkorn, but without the Etzkorn pressure requirements, may be used to create conduits 102 or conduit segments 104 for the presently disclosed lighting tube 100, and the processes and methods for including a phosphor within the lighting tube casings of Etzkorn may be used to create conduits 102 or conduit segments 104 for light emitting units 110 using LED, UV-LED, or other light sources.

The middle layer 202 may also comprise a light diffusing film 402, that may be translucent. The use of a light diffusing film 402 provides a more uniform distribution of light from the lighting tube 100. While some embodiments may diffuse light with the outermost layer 204, as there are many durable materials that also diffuse light, the placement of a diffusion film 402 in the middle layer 202 would better mimic the appearance of a traditional neon tube which emits diffuse light from behind a glass barrier. The diffusion film 402 may also be used in conjunction with a lighting tube 100 that does not have a phosphor film 400, and relies on the light emitting chain 106 directly for the production of light. Particular embodiments may allow for a wide range of colors to be produced, even animated, using multi-color LEDs, which may be individually addressable, as is known in the art.

Furthermore, the middle layer 202 may also comprise a UV-blocking film 404 to reduce or eliminate ultra violet emissions from the light emitting units 110. UV light can be harmful to living beings, and can also degrade various plastics and other materials. In some embodiments, the units 110 may intentionally emit UV light (e.g. to excite a phosphor film 400, etc.), while in other embodiments UV light may be emitted as an unintentional by-product, along with visible light.

In some embodiments, the middle layer 202 may comprise one of a phosphor film 400, a diffusion film 402, and a UV-blocking film 404. Other embodiments may have two of these films, and still other embodiments may have all three. It should be noted that in some embodiments, the diffusion film 402 may also block UV light, while in other embodiments they may be two separate films. In embodiments comprising a phosphor film 400 and a UV-blocking film 404, the UV-blocking film 404 may be located between the phosphor film 400 and the outer layer 204. In still other embodiments, the middle layer 202 may comprise other films that modify or otherwise interact with one or more properties of light.

It should be noted that although the functions of luminescence, diffusion, and absorption/blocking have been attributed above to structures described as films, the term "film" should not be construed as limiting. These films are not required to be discrete structures or membranes, nor are they required to be formed separately and subsequently assembled.

In some embodiments, one or more of these films may be a coating. The coating(s) may be printed on the exterior surface of the inner layer 200 and then sealed in by applying a protective coating as the outer layer 204. The outer layer 204 may be sprayed, printed, or applied using commercially known or proprietary applications onto other layers. Alternatively, the coating(s) may be printed, sprayed or applied in the manners listed above on the interior surface of outer layer 204, and the inner layer 200 may be inserted into the coated outer layer 204 as a tube. This may then be processed into one conduit segment 104 through heat, radiation, chemical bonding, or any other method known in the art. In the alternative, the coating(s) may be applied to the interior of the outer liner 204 and then covered with a sealer, making the sealer the inner layer 200. These options are not considered the only alternatives, but are presented only as non-limiting examples.

Conduit segments 104 and conduits 102 may be made with materials, like plastics, that are capable of being shaped into the desired shape by applying heat to the material. In some embodiments, particularly those where the phosphor, diffusion, and/or UV blocking films are mixed into the plastic forming the conduits 102 or a conduit layer, the conduit 102, segment 104, or layer may be formed using extrusion, pultrusion, injection or other molding methods known in the art. In other embodiments, the conduit 102 or conduit segments 104 may be formed in halves (top and bottom half) and assembled together at the lighting installation site before or after the light emitting chain 106 is inserted into the conduit 102. After initial formation, for particular material embodiments, when at a higher temperature, the material may then be flexible and capable of bending into the desired shape for the lighting tube 100.

Figure 5:
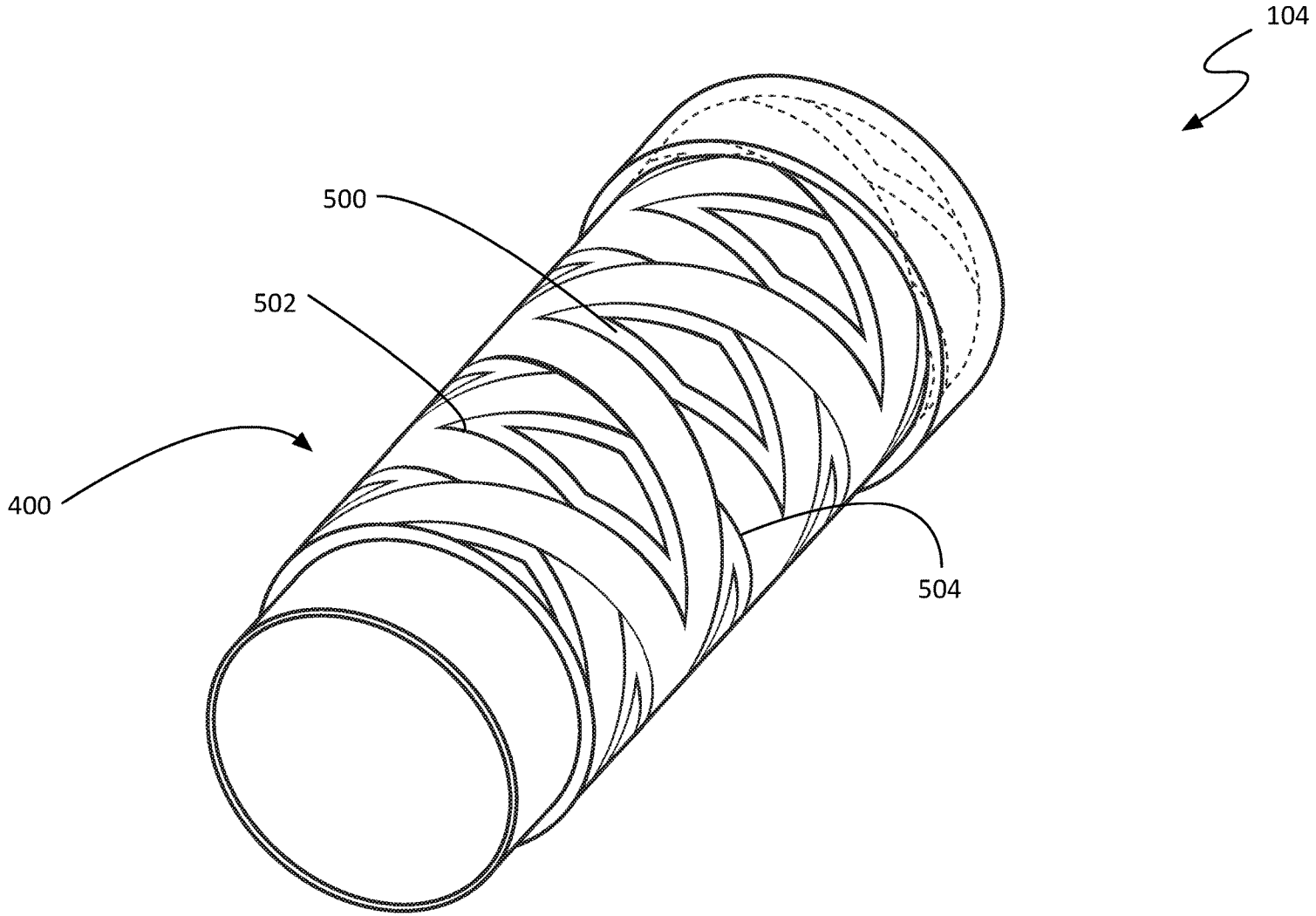
FIG. 5 is a perspective view of a conduit segment having a patterned middle layer.

FIG. 5 is a perspective view of a non-limiting example of a conduit segment 104 having a patterned phosphor film 400. According to various embodiments, one or more films in the middle layer 202 may be patterned to generate or modify light in a non-uniform manner. While FIG. 5 is showing a patterned phosphor film 400, other embodiments may comprise a patterned diffusion film 402 and/or UV-blocking film 404.

Patterning the phosphor film 400 may result in interesting, even dynamic, appearances. For example, in some embodiments, the phosphor film 400 may comprise a first phosphor 500 and a second phosphor 502, each printed into the phosphor film 400, distributed in a pattern 504. Each of these phosphors luminesce in response to exposure to different wavelengths of light. In some embodiments, the first 500 and second 502 phosphors may be printed into separate films, while in other embodiments they may be printed on the same film. Some embodiments may make use of more than two phosphors. Some embodiments may comprise more than one phosphor, but without patterning.

Different phosphor substances emit different colors and are activated at different wavelengths of light. Therefore, with these different phosphors printed into the phosphor layer 400, light sources within the chain 106 may be used to activate different parts of the pattern 504 in a predetermined sequence in time. The same lighting tube 100 could thus be used to emit different colors and patterns according to the desire of the user. For example, if a particular conduit 102 has three different phosphor coatings or films that are activated at three different wavelengths, then the units 110 within the conduit 102 may be used to activate these different phosphor coatings or films at different times, thus creating a moving pattern effect, or activate them at the same time, thus varying the illumination level as one, two, or all three phosphors luminesce.

According to various embodiments, a light emitting chain 106 is inside of the conduit 102, emitting light that passes through the conduit 102 and/or excites a phosphor in the conduit 102. The light emitting chain 106 comprises a plurality of light emitting unit 110 that are spaced along a plurality of control wires 108, as previously discussed. Each unit 110 has a plurality of faces 604, each capable of emitting light.

Figure 6A:
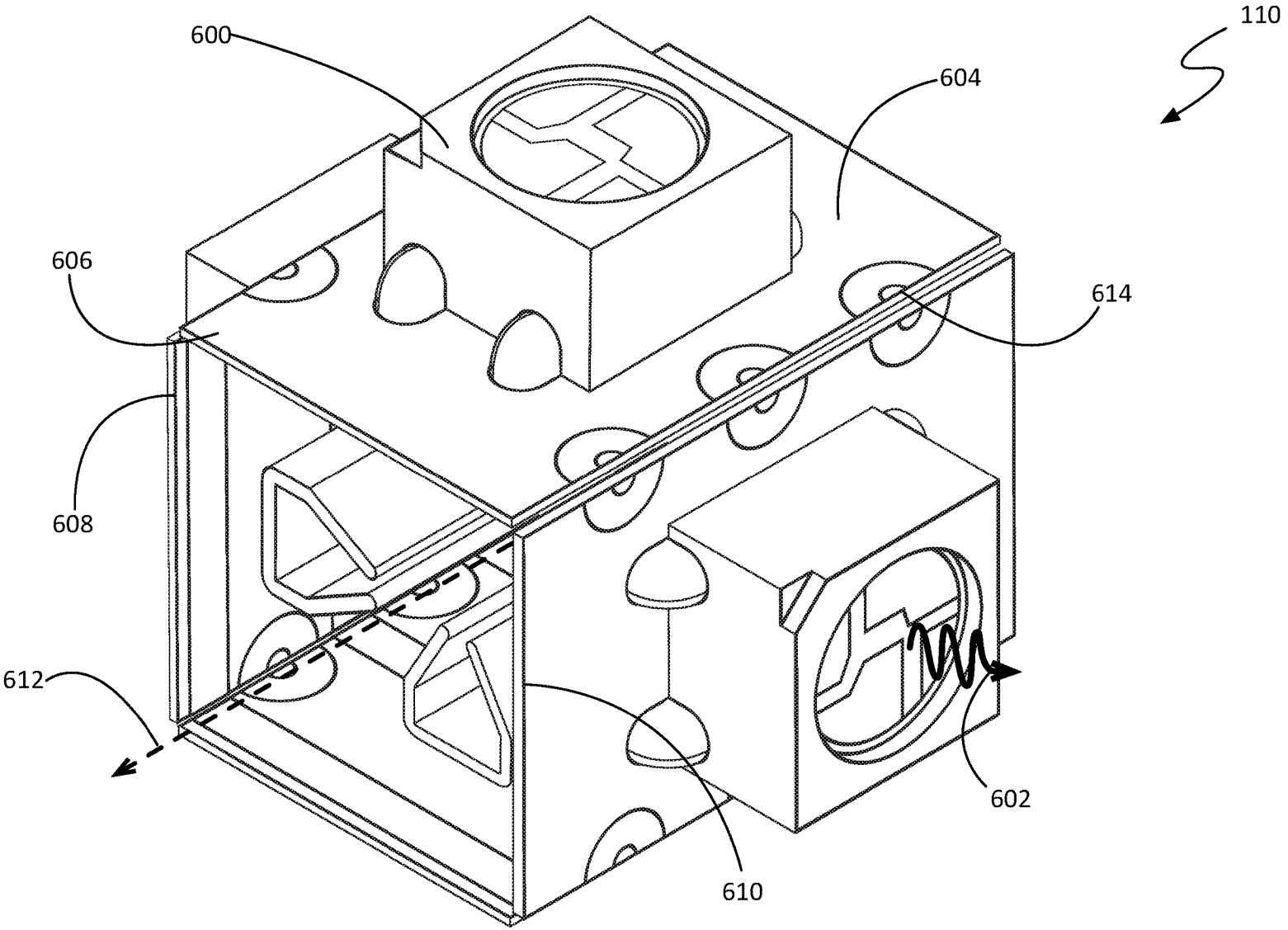
FIG. 6A is a perspective view of a light emitting unit.
Figure 6B:
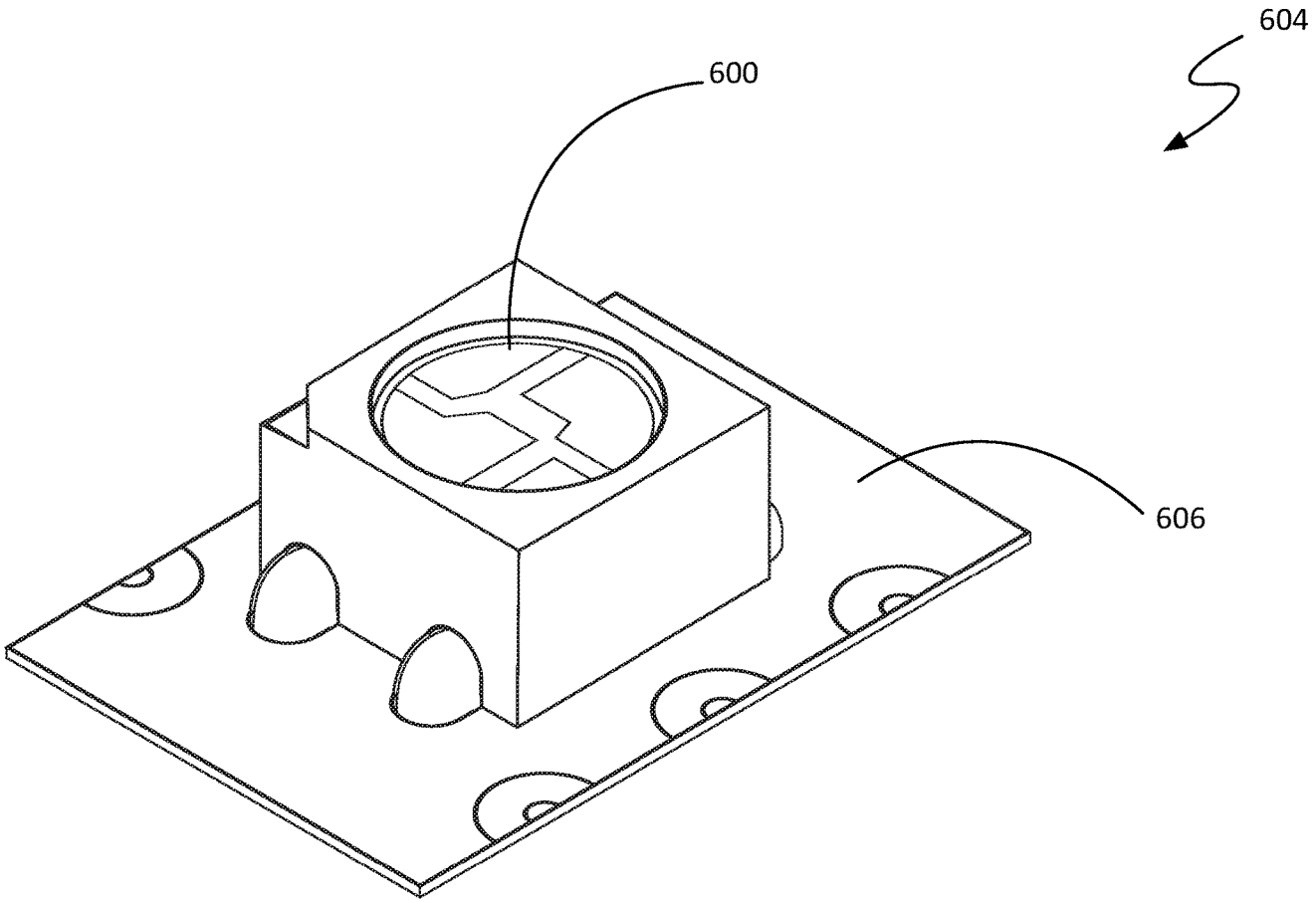
FIG. 6B is a perspective view of a face of a light emitting unit.
Figure 6C:
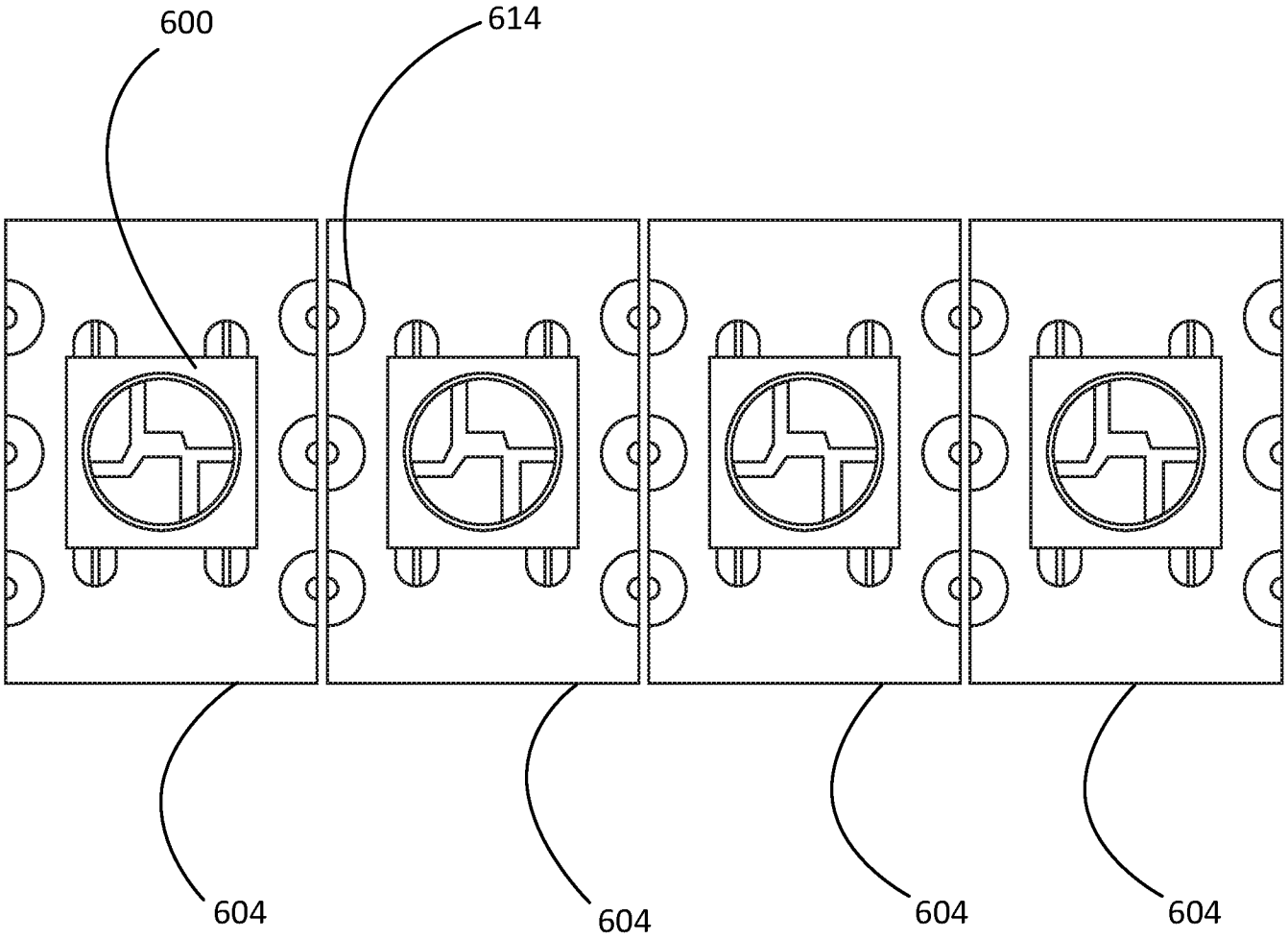
FIG. 6C is a top view of an flattened light emitting unit.

FIGS. 6A-6C are various views of a non-limiting example of a light emitting unit 110 and it's various faces. Specifically, FIG. 6A is a perspective view of a non-limiting example of a light emitting unit 110, FIG. 6B is a perspective view of a non-limiting example of a single face 604, and FIG. 6C is a top view of a plurality of faces 604 that make up the light emitting unit 110 of FIG. 6A, flattened.

Each light emitting unit 110 comprises a plurality of faces 604. According to various embodiments, each face 604 is a substrate 606 comprising an LED 600. In some embodiments, this substrate 606 is a printed circuit board, made of FR-2, FR-4, or any other material known in the art. In some embodiments, the substrate 606 may be chosen for heat dissipation properties, as well as structural. For example, one embodiment may comprise insulated metal substrate, or other substrates known in the art to be compatible with LEDs 600 in need of cooling. As an option, in some embodiments, each face 606 or each unit 110 may comprise one or more heat sinks to dissipate the heat of the LEDs 600.

In other embodiments, the substrate 606 making up the face 604 may be flexible. Examples include, but are not limited to, copper-clad foils and films, polyimide foil, Kapton, Pyralux, and the like. In some embodiments, the faces 606 may comprise a flexible material made from Pyrolytic Graphite Sheet(s) ("PGS"), in either a single or layered assembly. Embodiments having flexible faces may also employ flexible traces, as is known in the art.

The use of flexible substrates in the faces 606 of the units 110 may enable a unit 110 to bend to some degree, which may expand the range of geometries (e.g. sharpness of bend or curves, etc.) available when shaping the conduit 102. In other embodiments, the faces 606 may be rigid.

As shown, each light emitting unit 110 comprises a plurality of faces 606 that are interconnected to form a polygon 608 when viewed along a central axis 612 of the unit 110. In the context of the present description and the claims that follow, the central axis 612 of a light emitting unit 110 is the axis along which the plurality of units 110 are spaced to form a chain 106. In other words, the central axis 612 of the unit 110 is the longitudinal axis of the chain 106.

Shaping the units 110 to have a plurality of faces 604 that are each on a different side 610 of a polygon 608 provides an advantage over conventional LED lighting tubes and strips. As the number of sides 610 of the polygon 608 increases, the more uniform (radially) the light emitted by the unit 110. The non-limiting example shown in FIG. 6A has four faces 606, each on a different side 610 of a square. By using 3, 4, 5, or more faces 606 for each unit 110, the lighting tube 100 may provide illumination with fewer or less intense dark spots than found in conventional lighting solutions.

FIG. 6A shows a non-limiting example of a unit 110 shaped like a box. Other embodiments may make use of different shapes and polygons including but not limited to, circular, triangular, pentagonal, hexagonal, and the like.

In some embodiments the faces 606 are essentially flat. In other embodiments, the faces 606 may be curved, or otherwise non-planar. For example, in one embodiment, the faces 606 may each be curved such that when they are inter connected they form a cylinder running along the central axis 612.

Figure 7A:
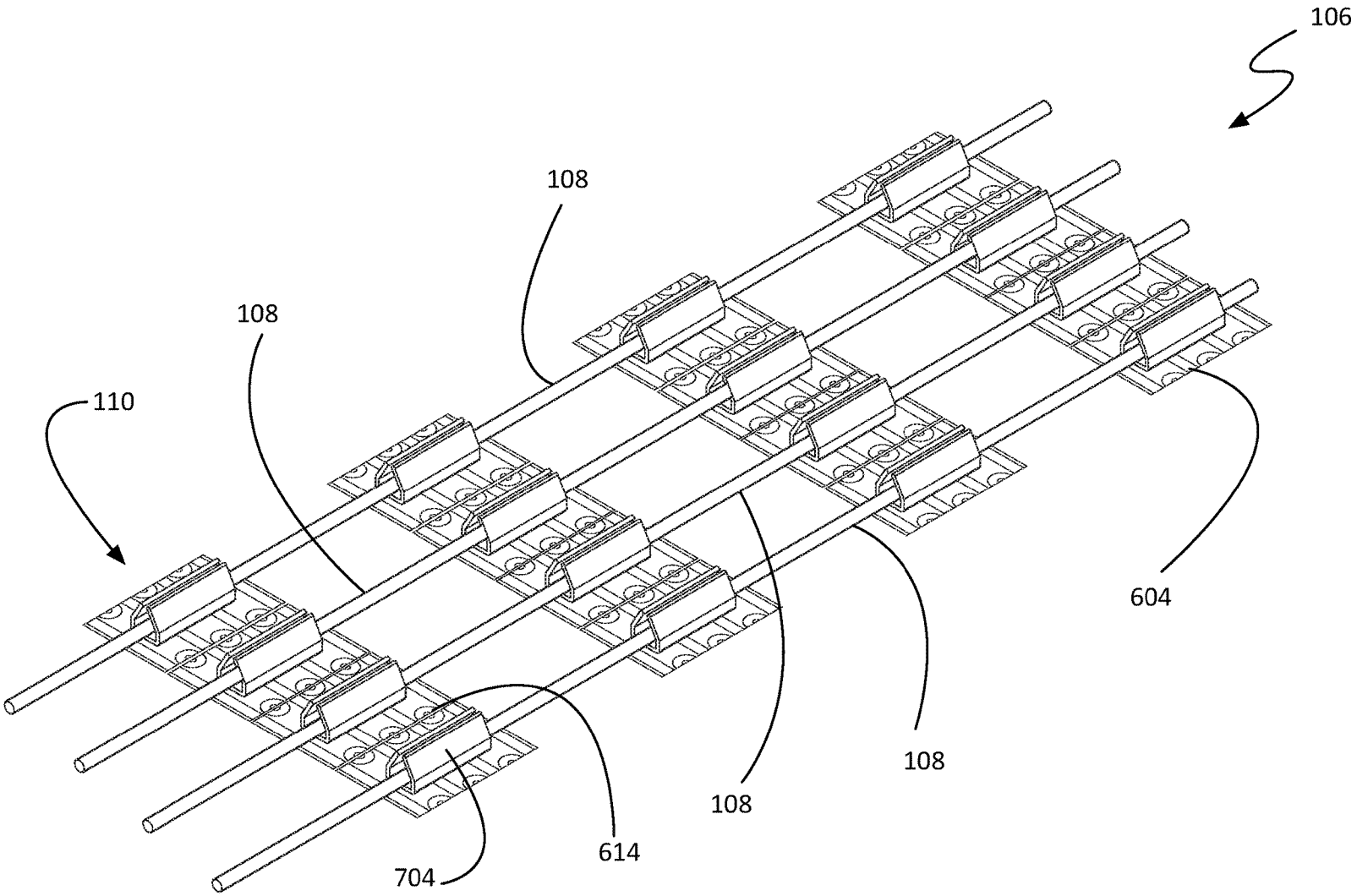
FIG. 7A is a rear perspective view of a flattened light emitting chain.

According to various embodiments, the faces 604 may be interconnected with each other through hinges 614. Interconnecting the faces 604 through hinges 614 may provide assembly advantages, as it permits the unit 110 to be assembled and wired in a flattened state, as shown in FIGS. 6C and 7A, and then folded into its final geometry (e.g. the unit 110 of FIG. 6A, etc.).

In embodiments making use of flexible substrates, the hinges 614 may simply be embodied as a folded portion of the substrate material, as would be the case with a thin plastic material being used as the substrate. In some embodiments, the hinges 614 may be separately attached as a continuous hinge running the length of the face 606, or as discrete hinges, as shown in FIG. 6A. In some embodiments, the hinges 614 may be a rubber or silicone material that is over-molded to the substrates 606 to allow flexibility in the attachment points between the faces 604. In other embodiments, the hinge elements may be formed as part of the substrate 606 material as a "living hinge" or other integrated hinge.

Each face 604 is configured to emit light. According to various embodiments, each face 604 may comprise one or more light emitting diodes (LEDs) 600. Examples include, but are not limited to, single wavelength LEDs, UV LED, RGB LED, RGBW LED, white LED, O-LEDs, Q-LEDs, smart LED, and any other LEDs known or yet to be discovered. Other embodiments may employ other light sources, as is known in the art. It should be noted that in other embodiments, some or all of the LEDs 600 referred to herein may be replaced by other types of light sources.

In the context of the present description and the claims that follow, when mention is made of an LED 600, it may refer to a single electronic component and may also refer to a light emitting diode that is part of a component containing multiple light emitting diodes packaged together, such as multi-color LEDs.

Additionally, in the context of the present description and the claims that follow, a "single wavelength" refers to the wavelength range of a LED that appears to emit a single color of light (e.g. "red", etc.) due to its use of only one type of semiconductor material, rather than multiple semiconductor materials with varying band gap energies. The term "single wavelength LED" is not intended to be limited to LEDs with high or laser-like spectral coherence.

According to various embodiments, each face may comprise a single LED 600. In some embodiments, that LED may emit a single wavelength 602 of light. In other embodiments, that LED may be multispectral, able to emit multiple wavelengths 602 of light.

In other embodiments, each face may comprise a plurality of LEDs 600, each of which may emit a single wavelength, or may be multispectral. For example, an embodiment of a lighting tube 100 that comprises a patterned phosphor film 400 making use of a first phosphor 500 and a second phosphor 502 may be implemented using light emitting units 110 whose faces 604 each have a first LED 600*a* emitting a first wavelength 602*a* and a second LED 600*b* emitting a second wavelength 602*b*. The first and second wavelengths are chosen to incite luminescence in the first and second phosphors, respectively, and may be two different wavelengths within the ultraviolet range of the spectrum. Another example may make use of faces 604 having both a UV LED and a RGB LED, or some other combination of LEDs.

In some embodiments, every unit 110 in a chain 106 may employ the same type of LED 600 (e.g. homogeneous units). In other embodiments the chain 106 may have heterogeneous units 110. For example, in some embodiments, the spacing of the units 110 on the chain 106 is close enough that uniform illumination may be provided by using every other or every Nth unit 110, allowing the use of heterogeneous units 110. This may be advantageous, as it may allow the creation of a variety of light emitting chains 106 with different functionality (e.g. single color, multicolor, animated, patterned, etc.) by using interchangeable units 110 with the same architecture (and same manufacturing process), but different LEDs.

Figure 7B:
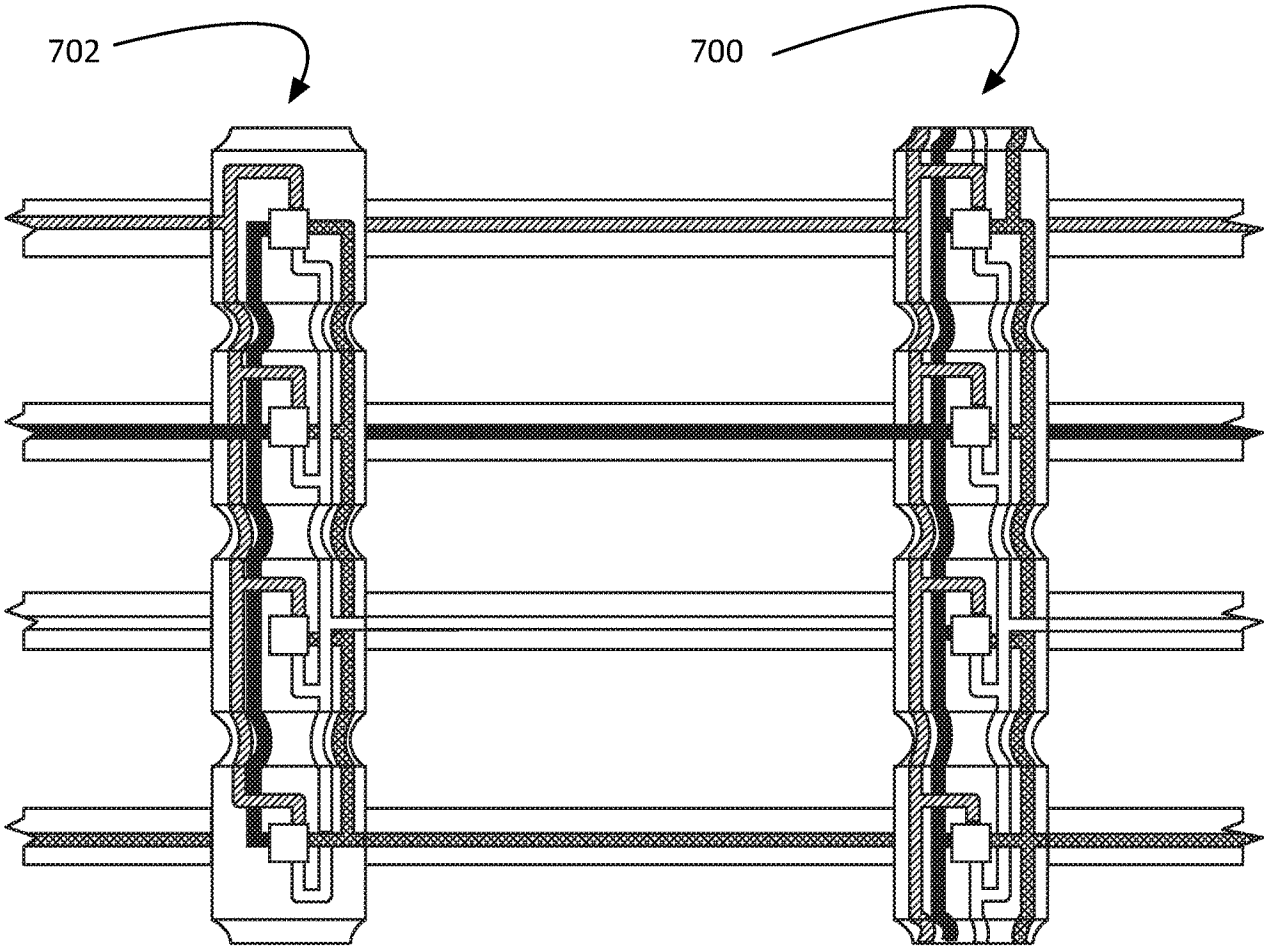
FIG. 7B is a schematic view of two wiring schemes.

FIG. 7A is a rear perspective view of a non-limiting example of a flattened light emitting chain 106 having four light emitting units 110. FIG. 7B is a schematic view of a non-limiting example of a continuous trace design 700 and a non-continuous trace design 702.

According to various embodiments, the units 110 of a chain 106 are attached to and spaced along a plurality of control wires 108, allowing the chain to be pulled along a non-linear path within a shaped conduit 102. The units 110 are also communicatively coupled to these control wires 108, in series, providing power and control.

In some embodiments, the control wires 108 of a chain 106 may pass through, or along the central axis 612 of each unit 110, advantageously preventing a control wire 108 from obscuring an LED 600. In other embodiments, the control wires 108 may be attached to each unit 110 elsewhere.

According to various embodiments, including the non-limiting example shown in FIG. 7A, the LEDs 600 of each face 604 may have wires extending from the front side of the face 604 to the rear side of the face 604 where wire connectors 704 are electrically coupled to the LEDs 600.

As a specific example, and as shown in FIG. 7A, a plurality of units 110 may be laid out and spaced for attachment to control wires 108 associated with each LED 600. Control wires 108 associated with each LED 600 are then attached to the wire connectors 704. In some embodiments, the wire connectors 704 may include a sharpened prong that punctures the wire casing of a wire passing through the wire connector 704 to make electrical contact with the wire connector 704. In other embodiments, the wire connectors 704 may employ any other method known in the art for making electrical contact with a wire, including but not limited to solder pads. After the wires are attached, although they could be attached after the light emitting units 110 are shaped, each light emitting unit 110 is shaped into a rectangular shape (e.g. unit 110 of FIG. 6A, etc.).

In some embodiments, the number of control wires 108 may be constrained by electronic matters, and may be related to the type of LEDs used. (i.e. the number of contacts to active the LEDs). See, for example the four control wires 108 of FIG. 7B that correlate to the red, green, blue, and ground requirements dictated by the use of RGB LEDs.

In other embodiments, the number of control wires 108 may be constrained by mechanical or manufacturing matters, and may be related to the number of faces 604 used in each light emitting unit 110. As a specific example, in an embodiment where each face of four-faced units 110 has one, single wavelength LED 600, only two control wires 108 would be required to fully activate each unit 110. In other embodiments with a more complex controller, only two control wires 108 may be required to fully activate each unit with a full multi-color LEDs being used as well. However, to facilitate manufacturing and/or make the connection between the units 110 and control wire 108 more robust and configured for pulling the chain 106 through a conduit 102, additional wires may be used, such as a wire for each face 604.

In embodiments making use of multispectral LEDs, such as RGB, multiple UV wavelengths (i.e. for multiple phosphors), different white LEDs (e.g. bright+medium+soft to provide different color temperatures, etc.), and the like, each control wire 108 may be coupled to the LED of each face 604 in the same unit 110 in a different manner (e.g. wire 1 connects to a wire connector coupled to the Red wire of a RGB LED while wire 2 connects to a wire connector coupled to the Blue wire of a RGB LED on a different face in that unit 110). According to various embodiments, those faces 604 are also interconnected to allow each control wire 108 to interact with each LED in the same way. In other words, in each unit 110, each face 604 may be communicatively coupled to all of the control wires 108, either directly or through traces on the unit 110.

In some embodiments, the faces 604 of a unit 110 are communicatively coupled through a plurality of traces, wires, or other communication channels. FIG. 7B shows two non-limiting examples of trace designs.

The continuous trace design 700 could be laid down on a continuous line of faces 604, each face 604 having a trace design that is identical, and then cut the faces into units 110 (i.e. 3, 4, 5, 6, or more faces 604 for each unit 110) prior to attachment to control wires 108 and folding.

The non-continuous trace design 702 is specific to each face 604 within a unit 110. While this design may not have the manufacturing advantages of the continuous trace design 700, it may be compatible with a wider range of hinge types. Those skilled in the art will recognize that other trace designs may be implemented in other embodiments.

It should also be noted that FIG. 7B is a schematic view, and that while the faces 604 appear to be joined by continuous hinges across which traces are disposed, those skilled in the art will recognize that the same design could be implemented in different unit architectures using wires, or other methods.

Figure 7C:
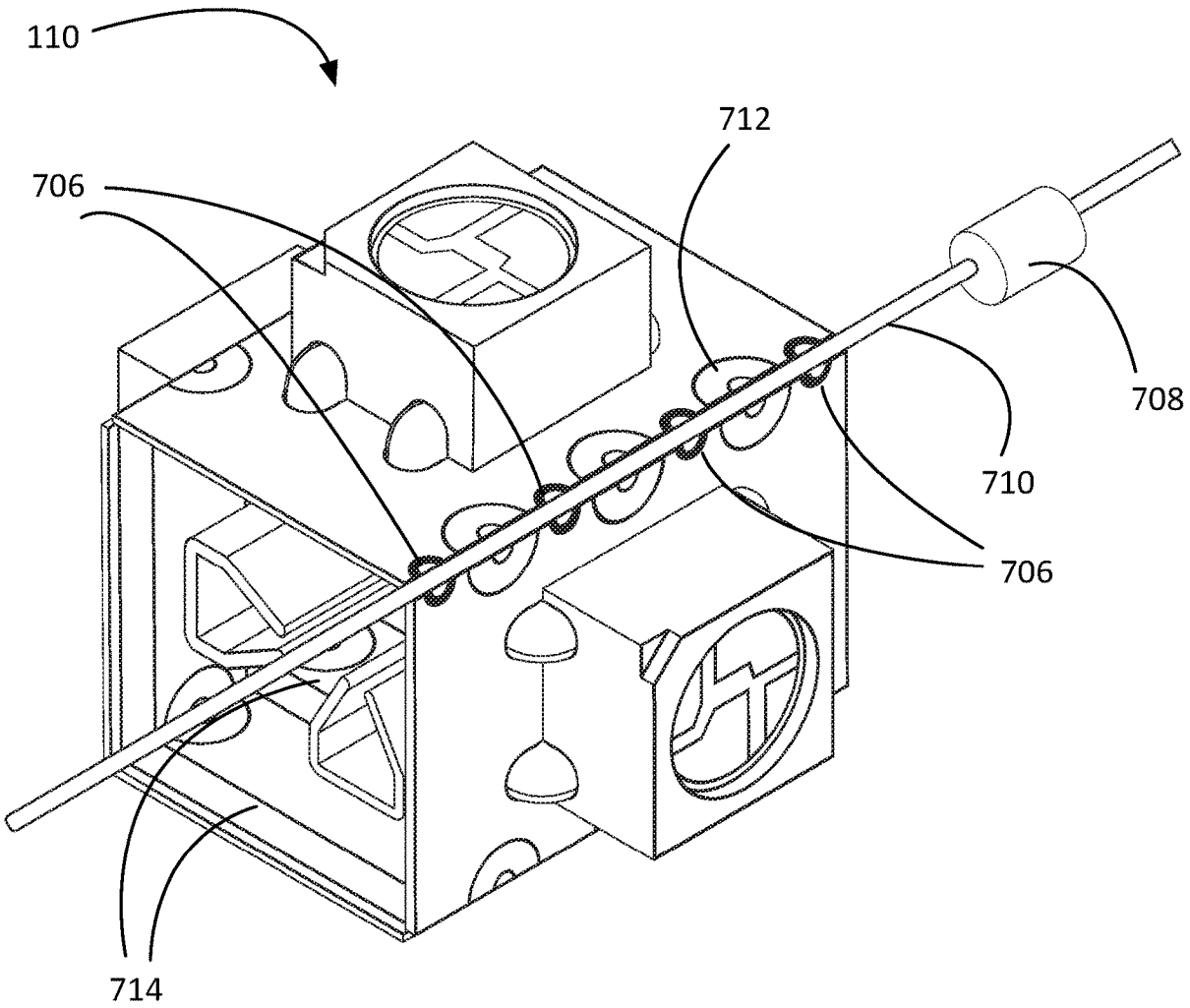
FIG. 7C is a perspective view a light emitting unit with a signal line coupled to the traces.

In some embodiments, the hinges 614 may also serve as inter-face communication pathways that include a connected processor linked at the hinge and an additional signal line(s) within or without polygon 608 to individually activate LED segments. FIG. 7C is a perspective view of a non-limiting example of a light emitting unit 110 with a signal line 710 coupled to the traces 714 within the unit 110. Specifically, an electrical connector 706 is coupled to each of the exposed traces 714 where the unit 110 is closed with welds 712. The electrical connector 706 may be tack welded to the three exposed conductive perpendicular semi-circles for structural integrity. In particular embodiments where additional control functionality is needed for the LED unit assemblies, an additional processor 708 (such as a barrel-type processor) may be added between each LED unit assembly to provide an extra control signal line 710 and unit control.

Those skilled in the art will recognize that other methods may be used to couple the units 110 to a control wire 108, and different types and numbers of control wires 108 may be employed, depending on the method of control. For example, the requirements of a light emitting chain 106 having units that are individually addressable may be different from the requirements when each unit is not individually addressable. As an option, some embodiments may further comprise a cable or tether running along with the control wires 108 to enhance the signal capacity and/or mechanical strength of the chain 106.

Some embodiments of the lighting tube 100 make use of a light emitting chain 106 made up of a plurality of rigid or semi-rigid light emitting units 110 spaced along a plurality of control wires 108. Other embodiments may generate light for transmission and/or excitation of phosphors using an elongated, flexible light emitting structure that resembles a single, elongated light emitting unit 110, in that it has a plurality of faces, each having a plurality of light sources. While this elongated light emitting unit also has control wires 108, they are not used to create a chain, but rather are just for controlling the light sources. The elongated unit is made of flexible substrate and traces, allowing the unit to bend while following the path within the conduit 102.

Figure 8A:
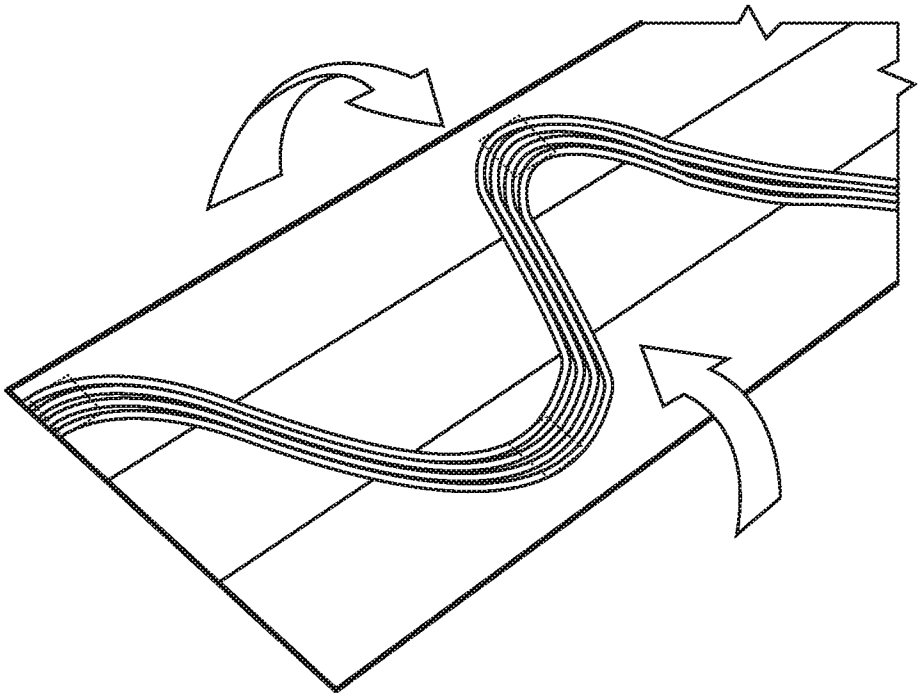
FIGS. 8A-8D are perspective views of various alternative unit architectures, flattened and assembled.
Figure 8B:
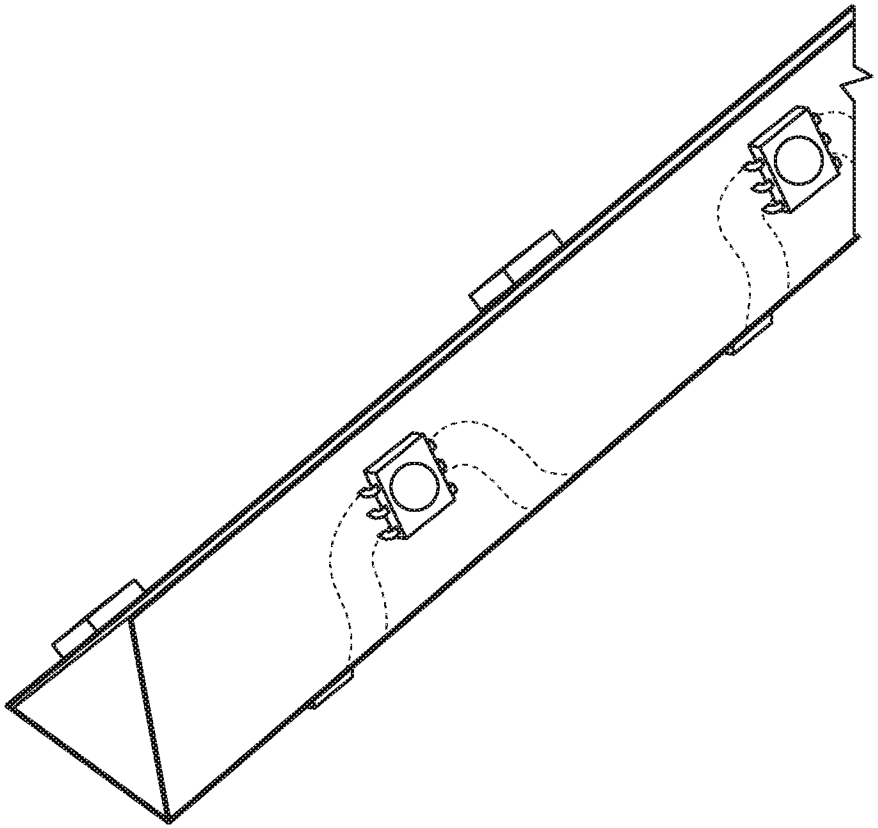
Figure 8C:
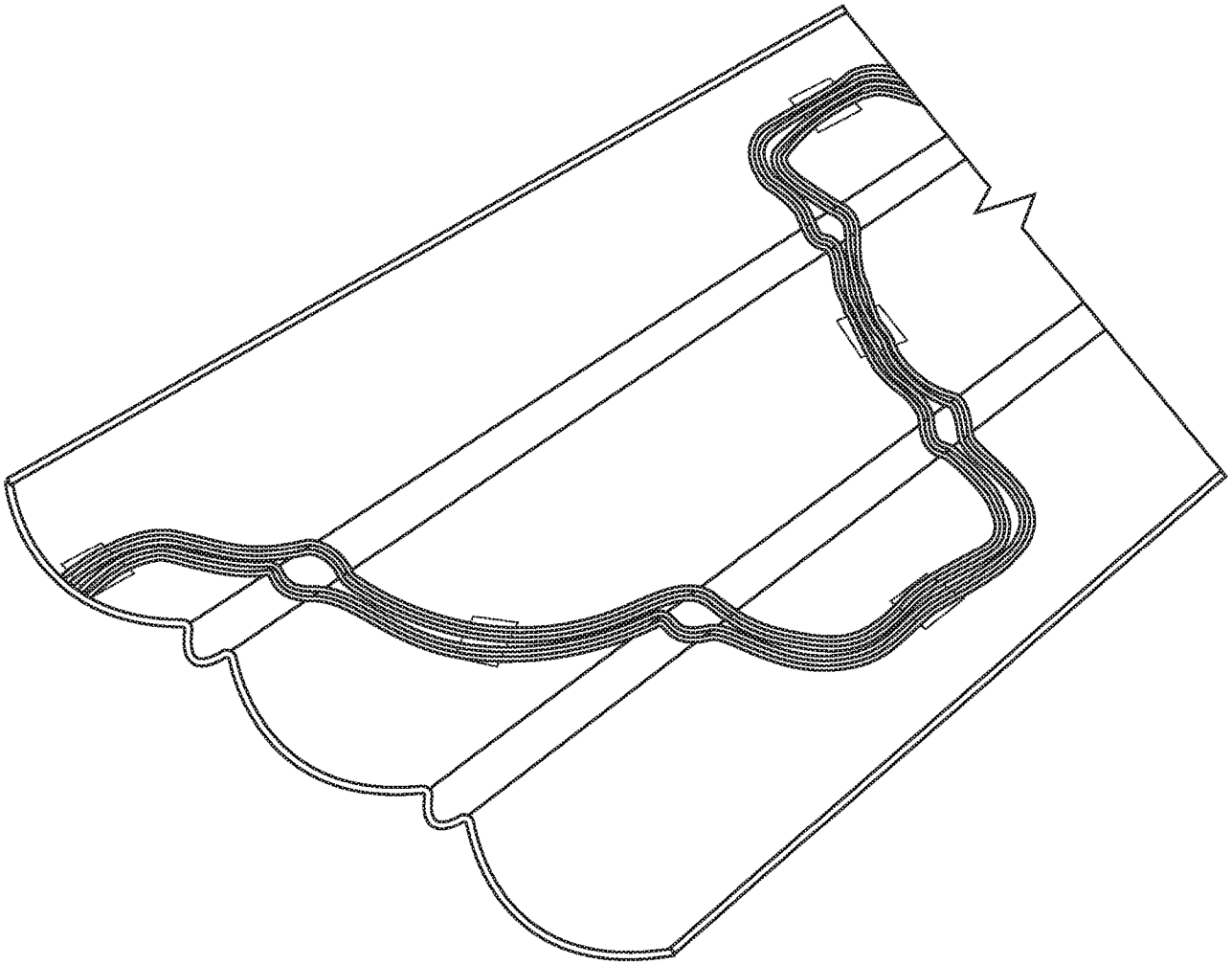
Figure 8D:
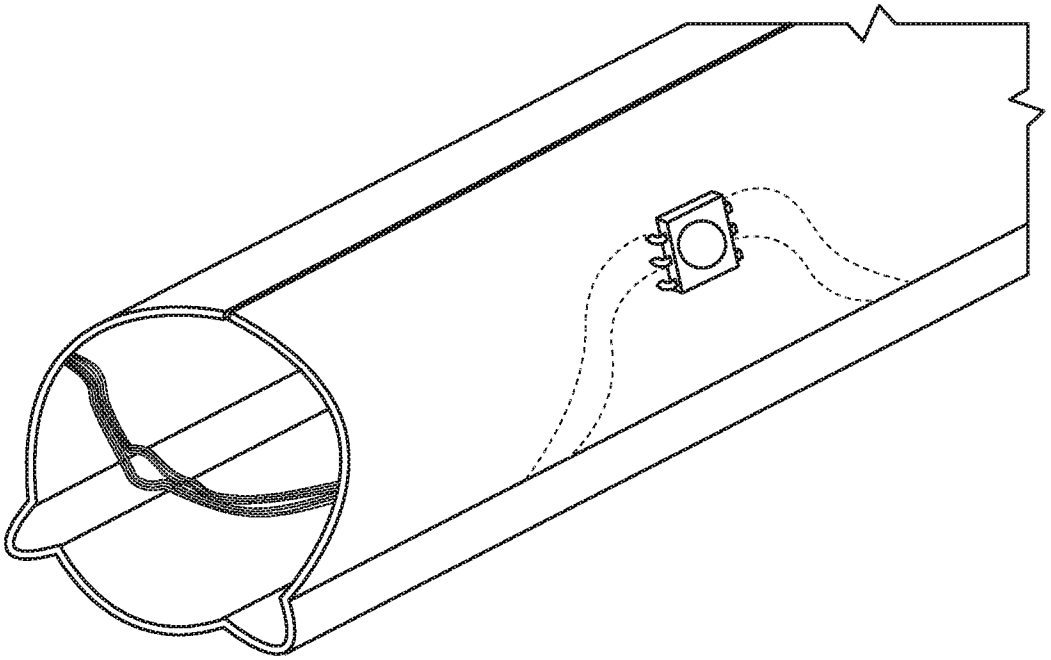

FIGS. 8A-8D show perspective views of different shapes for an elongated light emitting unit, both folded and open or flattened. Specifically, FIGS. 8A and 8B show a triangular elongated unit open and folded, respectively, while FIGS. 8C and 8D show a cylindrical elongated unit open and folded, respectively As shown, each side of these particular embodiments of elongated units have LED lights that face outward towards the conduit 102 when the unit is folded and inserted into the conduit 102 disclosed above. All sides of the tube 100 are thus lit by an LED, providing more consistent stimuli to activate the diffusing film layer, phosphor layer, and/or UV blocking film layer of the conduit 102.

Figure 9:
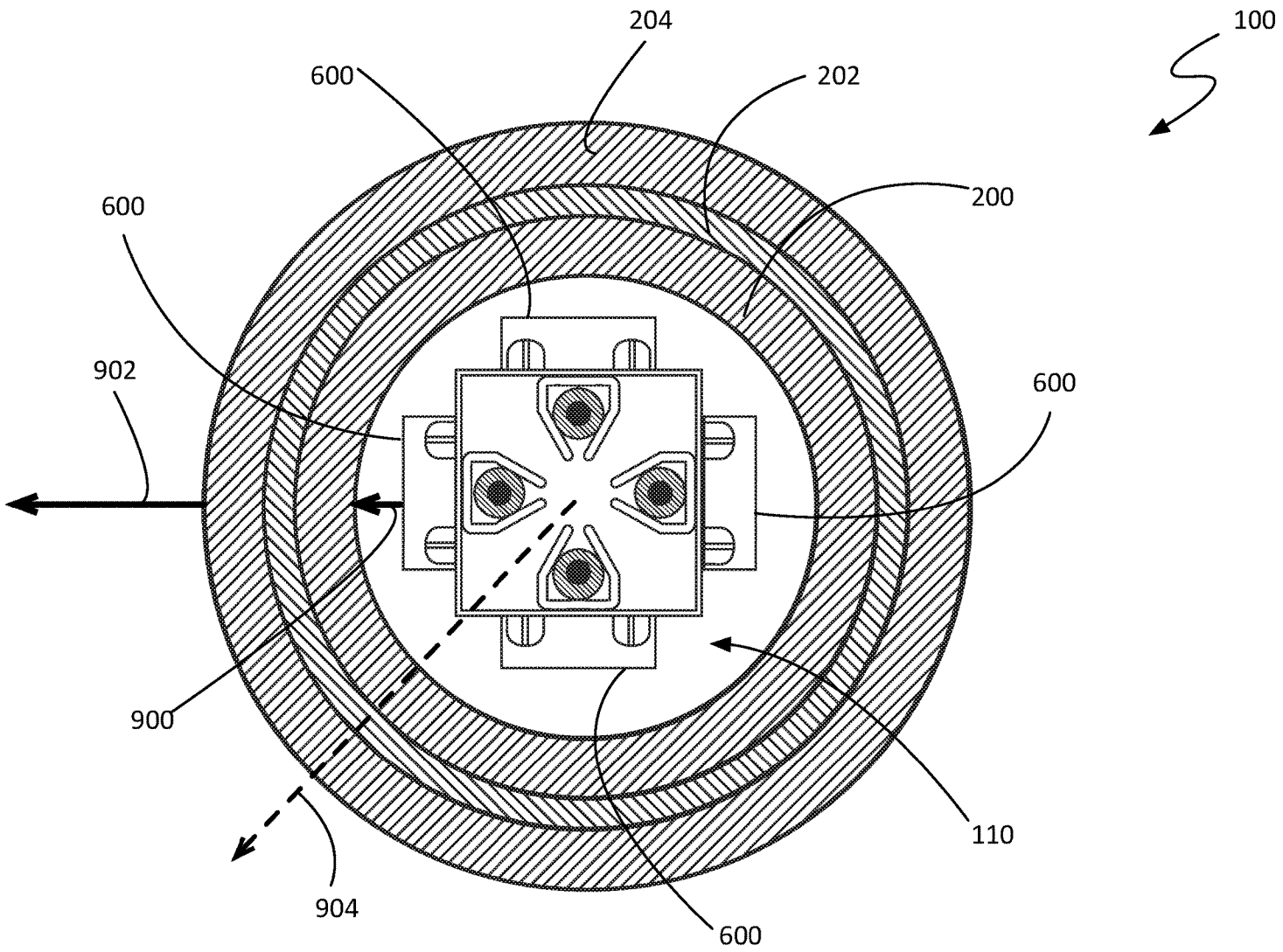
FIG. 9 is a cross-sectional view of a lighting tube taken through plane A of FIG. 1.

FIG. 9 is a cross-sectional view of a lighting tube 100 taken through plane A of FIG. 1. As shown, the light emitting chain 106 inside the conduit 102 emits light 900. This light 900 illuminates the middle layer 202 of the conduit 102 with illumination that is substantially uniform in all radial directions 904 (i.e. directions normal to the central path of the conduit 102).

In some embodiments, only a portion 902 of the light 900 emitted by the chain 106 passes through the outer layer 204. In other embodiments, very little to none of the light 900 passes through the outer layer 204, but is instead blocked by the middle layer 202 that luminesces upon exposure to the light 900.

In the context of the present description and the claims that follow, substantially uniform illumination is light whose optical characteristics such as intensity and wavelength are uniform enough through out at least the majority of the conduit and in all radial directions 904 that an ordinary observer would not be able to discern variations, or distinguish the uniformity of the illumination from that of a conventional neon tube light.

According to various embodiments, the control wires 108 may be coupled to wire connectors, like a plug, that may subsequently be connected to a power source or a powered control unit. The control unit for a light emitting chain 106 may be any control unit known in the art for controlling particular lights on a light string. Those of ordinary skill in the art will understand how to program such a control unit for the particular configurations and architectures shown herein without undue experimentation.

Where the above examples, embodiments and implementations reference examples, it should be understood by those of ordinary skill in the art that other lighting tubes and light emitting units could be intermixed or substituted with those provided. In places where the description above refers to particular embodiments of a lighting tube, it should be readily apparent that a number of modifications may be made without departing from the spirit thereof and that these embodiments and implementations may be applied to other to lighting tubes as well. Accordingly, the disclosed subject matter is intended to embrace all such alterations, modifications and variations that fall within the spirit and scope of the disclosure and the knowledge of one of ordinary skill in the art.

What is claimed is:

1. A lighting tube for uniform illumination, comprising:

a conduit comprising a plurality of conduit segments that are hollow, each conduit segment comprising an inner layer, an outer layer, and a middle layer between the inner layer and the outer layer, the middle layer comprising at least two of a phosphor film comprising a first phosphor, a diffusion film that is translucent, and a UV-blocking film; and a light emitting chain located inside of and extending along a length of the conduit, the light emitting chain comprising:

a plurality of control wires; and a plurality of light emitting units spaced along and communicatively coupled in series through the plurality of control wires, each light emitting unit comprising a plurality of faces interconnected to form a polygon when viewed along a central axis of the light emitting unit, with each face of the plurality of faces being on a different side of the polygon, each face being a substrate having an LED communicatively coupled to the plurality of control wires, the LED capable of emitting light with a first wavelength that causes the first phosphor of the phosphor film to luminesce along the length of the light tube;

wherein the illumination of the middle layer by the light emitting chain is substantially uniform in all radial directions; and wherein each conduit segment is coupled to a neighboring conduit segment such that the middle layer of the conduit segment meets the middle layer of the neighboring segment across an interface surface having a surface area greater than the radial cross-sectional area of the middle layer of the conduit segment.

2. The lighting tube of claim 1, wherein the phosphor layer further comprises a second phosphor different from the first phosphor, and wherein each face of each light emitting unit comprises an LED capable of emitting light with a second wavelength that causes the second phosphor of the phosphor film to luminesce.

3. The lighting tube of claim 1, wherein the first phosphor is distributed in the phosphor film to form a pattern.

4. The lighting tube of claim 1, wherein each face comprises an LED configured to emit light in each of at least two different color combinations selected from among ultraviolet, RGB, RGBW, white, and a single wavelength color.

5. A lighting tube, comprising:

a conduit comprising at least two conduit segments that are hollow, each of the at least two conduit segments comprising an inner layer, an outer layer, and a middle layer between the inner layer and the outer layer; and a light emitting chain located inside of and running along a length of the conduit, the light emitting chain comprising:

a plurality of control wires; and a plurality of light emitting units within each of the at least two conduit segments configured to illuminate in all radial directions, the plurality of light emitting units separated from each other by and communicatively coupled to each other in series through the plurality of bendable control wires, each light emitting unit comprising a plurality of faces interconnected to form a polygon when viewed along a central axis of the light emitting unit, with each face of the plurality of faces on a different side of the polygon, each face being a substrate having an LED communicatively coupled to the plurality of control wires, the control wires configured to bend into a desired shape for the lighting tube;

wherein the middle layer allows, at most, a portion of the light emitted by the light emitting chain to pass through the outer layer;

wherein the illumination of the middle layer by the light emitting chain is substantially uniform in all radial directions; and wherein each of the at least two conduit segments is coupled to a neighboring conduit segment such that the middle layer of the at least two conduit segments physically contacts the middle layer of the neighboring segment across an interface surface having a surface area greater than the radial cross-sectional area of the middle layer of the at least two conduit segments.

6. The lighting tube of claim 5, wherein the middle layer comprises a phosphor film comprising a first phosphor, and wherein the LED of each face is capable of emitting light with a first wavelength that causes the first phosphor to luminesce along the length of the light tube.

7. The lighting tube of claim 6, wherein the middle layer further comprises a second phosphor different from the first phosphor, and wherein each face of each light emitting unit comprises an LED capable of emitting light with a second wavelength that causes the second phosphor of the phosphor film to luminesce.

8. The lighting tube of claim 6, wherein the first phosphor is distributed in the phosphor film to form a pattern.

9. The lighting tube of claim 5, wherein the middle layer comprises a diffusion film that is translucent.

10. The lighting tube of claim 5, wherein each face comprises an LED configured to emit light in each of at least two different color combinations selected from among ultraviolet, RGB, RGBW, white, and a single wavelength color.

11. A lighting tube, comprising:

a conduit comprising a plurality of layers and at least two conduit segments; and a light emitting chain surrounded by and running along a length of the conduit, the light emitting chain comprising:

a plurality of control wires; and a plurality of light emitting units within each of the at least two conduit segments, the plurality of light emitting units separated from each other by and communicatively coupled to each other in series through the plurality of bendable control wires, each light emitting unit comprising a plurality of faces interconnected to form a polygon when viewed along a central axis of the light emitting unit, with each face of the plurality of faces being on a different side of the polygon, each face being a substrate having an LED communicatively coupled to the plurality of control wires, the control wires configured to bend into a desired shape for the lighting tube;

wherein the illumination of the plurality of layers by the light emitting chain is substantially uniform in all radial directions.

12. The lighting tube of claim 11:

wherein the plurality of layers comprises an inner layer, an outer layer, and a middle layer between the inner layer and the outer layer; and wherein the middle layer allows, at most, a portion of the light emitted by the light emitting chain to pass through the outer layer.

13. The lighting tube of claim 12, wherein the middle layer comprises a phosphor film comprising a first phosphor.

14. The lighting tube of claim 13, wherein the middle layer further comprises a UV blocking film between the phosphor film and the outer layer.

15. The lighting tube of claim 13, wherein the phosphor layer further comprises at least a second phosphor different from the first phosphor, and wherein each face of each light emitting unit comprises an LED capable of emitting light with a second wavelength that causes the at least a second phosphor of the phosphor film to luminesce.

16. The lighting tube of claim 13, wherein the first phosphor is distributed in the phosphor film to form a pattern.

17. The lighting tube of claim 12, wherein the middle layer comprises a diffusion film that is translucent.

18. The lighting tube of claim 11, wherein each of the at least two conduit segments is coupled to a neighboring conduit segment such that an active layer of the conduit segment meets the active layer of the neighboring segment across an interface surface having a surface area greater than the radial cross-sectional area of the active layer of the conduit segment.

19. The lighting tube of claim 11, wherein each face comprises an LED configured to emit light in each of at least two different color combinations selected from among ultraviolet, RGB, RGBW, white, and a single wavelength color.

20. The lighting tube of claim 11, wherein a junction between the at least two conduit segments includes a corner turn for the conduit.

* * * * *